US008508116B2

(12) United States Patent
Negley et al.

(10) Patent No.: US 8,508,116 B2
(45) Date of Patent: Aug. 13, 2013

(54) LIGHTING DEVICE WITH MULTI-CHIP LIGHT EMITTERS, SOLID STATE LIGHT EMITTER SUPPORT MEMBERS AND LIGHTING ELEMENTS

(75) Inventors: Gerald H. Negley, Durham, NC (US); Mark Edmond, Raleigh, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 12/776,947

(22) Filed: May 10, 2010

(65) Prior Publication Data

US 2011/0182065 A1 Jul. 28, 2011

Related U.S. Application Data

(60) Provisional application No. 61/298,701, filed on Jan. 27, 2010, provisional application No. 61/299,154, filed on Jan. 28, 2010, provisional application No. 61/299,183, filed on Jan. 28, 2010, provisional application No. 61/299,634, filed on Jan. 29, 2010.

(51) Int. Cl.

| | |
|---|---|
| ***F21V 9/00*** | (2006.01) |
| ***F21V 21/00*** | (2006.01) |
| ***F21V 15/01*** | (2006.01) |

(52) U.S. Cl.

USPC ..... 313/501; 313/504; 362/231; 362/382; 362/362

(58) Field of Classification Search

CPC ..... F21Y 2101/02; H01L 33/50; F21K 9/00
USPC ..... 313/498–512; 362/249.02, 84; 257/84

See application file for complete search history.

(56) References Cited

U.S. PATENT DOCUMENTS

| | | | |
|---|---|---|---|
| 4,918,487 | A | 4/1990 | Coulter, Jr. |
| 5,384,519 | A | 1/1995 | Gotoh |

(Continued)

FOREIGN PATENT DOCUMENTS

| | | |
|---|---|---|
| DE | 10 2007 043192 | 3/2009 |
| EP | 1 160 883 | 12/2001 |

(Continued)

OTHER PUBLICATIONS

U.S. Appl. No. 12/776,799, filed May 10, 2010.

(Continued)

*Primary Examiner* — Tracie Y Green
(74) *Attorney, Agent, or Firm* — Burr & Brown

(57) ABSTRACT

A lighting device in which a solid state light emitter in a first multi-chip light emitter is spatially offset relative to a solid state light emitter in a second multi-chip light emitter. A lighting device comprising first, second and third multi-chip light emitters, in which any solid state light emitter in the second multi-chip light emitter that is spatially offset relative to a first solid state light emitter on the first multi-chip light emitter by less than 10 degrees emits light of a hue that differs from the hue of light emitted by the first solid state light emitter by more than seven MacAdam ellipses. A solid state light emitter support member comprising a center region and at least first, second and third protrusions extending from the center region. A lighting device comprising at least a first housing member, and means for emitting substantially uniform light.

25 Claims, 10 Drawing Sheets

(56) References Cited

U.S. PATENT DOCUMENTS

| | | | | |
|---|---|---|---|---|
| 5,631,190 | A | 5/1997 | Negley | |
| 5,803,579 | A | 9/1998 | Turnbull et al. | |
| 5,912,477 | A | 6/1999 | Negley | |
| 6,132,072 | A | 10/2000 | Turnbull et al. | |
| 6,153,971 | A | 11/2000 | Shimizu et al. | |
| 6,212,213 | B1 | 4/2001 | Weber et al. | |
| 6,234,648 | B1 | 5/2001 | Borner et al. | |
| 6,513,949 | B1 | 2/2003 | Marshall et al. | |
| 6,538,371 | B1 | 3/2003 | Duggal et al. | |
| 6,550,949 | B1 | 4/2003 | Bauer et al. | |
| 6,552,495 | B1 | 4/2003 | Chang | |
| 6,577,073 | B2 | 6/2003 | Shimizu et al. | |
| 6,692,136 | B2 | 2/2004 | Marshall et al. | |
| 6,784,463 | B2 | 8/2004 | Camras et al. | |
| 6,817,735 | B2 | 11/2004 | Shimizu et al. | |
| 6,841,804 | B1 | 1/2005 | Chen et al. | |
| 6,914,267 | B2 | 7/2005 | Fukasawa et al. | |
| 6,936,857 | B2 | 8/2005 | Doxsee et al. | |
| 7,005,679 | B2 | 2/2006 | Tarsa et al. | |
| 7,008,078 | B2 | 3/2006 | Shimizu et al. | |
| 7,014,336 | B1 | 3/2006 | Ducharme et al. | |
| 7,061,454 | B2 | 6/2006 | Sasuga et al. | |
| 7,066,623 | B2 | 6/2006 | Lee et al. | |
| 7,095,056 | B2 | 8/2006 | Vitta | |
| 7,144,121 | B2 | 12/2006 | Minano et al. | |
| 7,213,940 | B1 | 5/2007 | Van De Ven et al. | |
| 7,358,954 | B2 | 4/2008 | Negley | |
| 7,365,485 | B2 | 4/2008 | Fukasawa et al. | |
| 7,614,759 | B2 | 11/2009 | Negley | |
| 7,718,991 | B2 | 5/2010 | Negley | |
| 7,722,220 | B2 | 5/2010 | Van de Ven | |
| 7,744,243 | B2 | 6/2010 | Van de Ven et al. | |
| 7,768,192 | B2 | 8/2010 | Van de Ven et al. | |
| 2002/0070681 | A1 | 6/2002 | Shimizu et al. | |
| 2003/0030063 | A1 | 2/2003 | Sosniak et al. | |
| 2003/0067773 | A1 | 4/2003 | Marshall et al. | |
| 2003/0076034 | A1 | 4/2003 | Marshall et al. | |
| 2003/0146411 | A1 | 8/2003 | Srivastava et al. | |
| 2004/0105261 | A1 | 6/2004 | Ducharme et al. | |
| 2004/0179366 | A1 | 9/2004 | Takeda et al. | |
| 2004/0217364 | A1 | 11/2004 | Tarsa et al. | |
| 2005/0082974 | A1 | 4/2005 | Fukasawa et al. | |
| 2006/0012989 | A1 | 1/2006 | Lee et al. | |
| 2006/0105482 | A1 | 5/2006 | Alferink et al. | |
| 2006/0180818 | A1 | 8/2006 | Nagai et al. | |
| 2007/0001188 | A1 | 1/2007 | Lee | |
| 2007/0137074 | A1 | 6/2007 | Van de Ven | |
| 2007/0139920 | A1 | 6/2007 | Van de Ven | |
| 2007/0139923 | A1 | 6/2007 | Negley | |
| 2007/0159091 | A1 | 7/2007 | Hirosaki et al. | |
| 2007/0170447 | A1 | 7/2007 | Negley | |
| 2007/0171145 | A1 | 7/2007 | Coleman | |
| 2007/0236911 | A1 | 10/2007 | Negley | |
| 2007/0263393 | A1 | 11/2007 | Van de Ven | |
| 2007/0267983 | A1 | 11/2007 | Van de Ven | |
| 2007/0268694 | A1* | 11/2007 | Bailey et al. | 362/231 |
| 2007/0274063 | A1 | 11/2007 | Negley | |
| 2007/0274080 | A1 | 11/2007 | Negley | |
| 2007/0278503 | A1 | 12/2007 | Van de Ven | |
| 2007/0278934 | A1 | 12/2007 | Van de Ven | |
| 2007/0278974 | A1 | 12/2007 | Van de Ven | |
| 2007/0279440 | A1 | 12/2007 | Negley | |
| 2007/0279903 | A1 | 12/2007 | Negley | |
| 2007/0280624 | A1 | 12/2007 | Negley | |
| 2008/0084685 | A1 | 4/2008 | Van de Ven | |
| 2008/0084700 | A1 | 4/2008 | Van de Ven | |
| 2008/0084701 | A1 | 4/2008 | Van de Ven | |
| 2008/0088248 | A1 | 4/2008 | Myers | |
| 2008/0089053 | A1 | 4/2008 | Negley | |
| 2008/0106895 | A1 | 5/2008 | Van de Ven | |
| 2008/0106907 | A1 | 5/2008 | Trott | |
| 2008/0112168 | A1 | 5/2008 | Pickard | |
| 2008/0112170 | A1 | 5/2008 | Trott | |
| 2008/0112183 | A1 | 5/2008 | Negley | |
| 2008/0130285 | A1 | 6/2008 | Negley | |
| 2008/0130298 | A1 | 6/2008 | Negley | |
| 2008/0136313 | A1 | 6/2008 | Van de Ven | |
| 2008/0137347 | A1 | 6/2008 | Trott | |
| 2008/0259589 | A1 | 10/2008 | Van de Ven | |
| 2008/0278928 | A1 | 11/2008 | Van de Ven | |
| 2008/0278940 | A1 | 11/2008 | Van de Ven | |
| 2008/0278950 | A1 | 11/2008 | Pickard | |
| 2008/0278952 | A1 | 11/2008 | Trott | |
| 2008/0278957 | A1 | 11/2008 | Pickard | |
| 2008/0304260 | A1 | 12/2008 | Van de Ven et al. | |
| 2008/0304261 | A1 | 12/2008 | Van de Ven | |
| 2008/0304269 | A1 | 12/2008 | Pickard | |
| 2008/0309255 | A1 | 12/2008 | Myers | |
| 2009/0108269 | A1 | 4/2009 | Negley | |
| 2009/0121238 | A1 | 5/2009 | Peck | |
| 2009/0160363 | A1 | 6/2009 | Negley | |
| 2009/0161356 | A1 | 6/2009 | Negley | |
| 2009/0184616 | A1 | 7/2009 | Van de Ven | |
| 2009/0184662 | A1 | 7/2009 | Given | |
| 2009/0184666 | A1 | 7/2009 | Myers | |
| 2009/0296384 | A1 | 12/2009 | Van de Ven | |
| 2009/0316393 | A1 | 12/2009 | Vissenberg et al. | |
| 2010/0102199 | A1 | 4/2010 | Negley | |
| 2010/0102697 | A1 | 4/2010 | Van de Ven | |
| 2010/0103678 | A1 | 4/2010 | Van de Ven | |
| 2010/0238645 | A1 | 9/2010 | Bailey | |

FOREIGN PATENT DOCUMENTS

| | | |
|---|---|---|
| EP | 2 083 211 | 7/2009 |
| JP | 10-163535 | 6/1998 |
| JP | 2003-515956 | 5/2003 |
| JP | 2003-529889 | 10/2003 |
| JP | 2004-080046 | 3/2004 |
| JP | 2004-103443 | 4/2004 |
| JP | 2004-356116 | 12/2004 |
| JP | 2005-142311 | 6/2005 |
| WO | 2005/013365 | 2/2005 |
| WO | WO 2005/124877 | 12/2005 |
| WO | 2006/028312 | 3/2006 |
| WO | 2008/010130 | 1/2008 |
| WO | 2008/137974 | 11/2008 |
| WO | 2009/046050 | 4/2009 |
| WO | 2010/038025 | 4/2010 |

OTHER PUBLICATIONS

U.S. Appl. No. 12/535,319, filed Aug. 4, 2009, Van den Ven.
U.S. Appl. No. 12/411,905, filed Mar. 26, 2009, Van de Ven.
U.S. Appl. No. 12/467,467, filed May 18, 2009.
U.S. Appl. No. 12/465,203, filed May 13, 2009, Pickard.
U.S. Appl. No. 12/551,921, filed Sep. 1, 2009, Pickard.
U.S. Appl. No. 12/541,215, filed Aug. 14, 2009, Van de Ven.
U.S. Appl. No. 12/566,936, filed Sep. 25, 2009, Van de Ven.
U.S. Appl. No. 12/566,850, filed Sep. 25, 2009, Van de Ven.
U.S. Appl. No. 12/566,857, filed Sep. 25, 2009, Van de Ven.
U.S. Appl. No. 12/621,970, filed Nov. 19, 2009, Van de Ven.
U.S. Appl. No. 12/566,861, filed Sep. 25, 2009, Van de Ven.
U.S. Appl. No. 12/582,206, filed Oct. 20, 2009, Pickard.
U.S. Appl. No. 12/607,355, filed Oct. 28, 2009, Pickard.
U.S. Appl. No. 12/683,886, filed Jan. 7, 2010, Pickard.
U.S. Appl. No. 12/704,995, filed Feb. 12, 2010, Van de Ven.
U.S. Appl. No. 12/566,142, filed Sep. 24, 2009.
U.S. Appl. No. 12/566,195, filed Sep. 24, 2009.
U.S. Appl. No. 12/704,730, filed Feb. 12, 2010.
U.S. Appl. No. 61/245,683, filed Sep. 25, 2009, Van de Ven.
U.S. Appl. No. 12/886,718, filed Sep. 21, 2010, Van de Ven.
U.S. Appl. No. 61/245,688, filed Sep. 25, 2009, Pickard.
U.S. Appl. No. 12/766,799, filed May 10, 2010.
Van de Ven et al., "Warm White Illumination with High CRI and High Efficacy by Combining 455 nm Excited Yellowish Phosphor LEDs and Red AlInGaP LEDs", First International Conference on White LEDs and Solid State Lighting.
Cree® XLamp® 7090 XR-E Series LED Binning and Labeling.
U.S. Appl. No. 29/383,040, filed Jan. 11, 2011, Dungan et al.
U.S. Appl. No. 12/886,718, filed Sep. 21, 2010, Van de Ven et al.

* cited by examiner

LIGHTING DEVICE WITH MULTI-CHIP LIGHT EMITTERS, SOLID STATE LIGHT EMITTER SUPPORT MEMBERS AND LIGHTING ELEMENTS

CROSS-REFERENCE TO RELATED APPLICATIONS

This application claims the benefit of U.S. Provisional Patent Application No. 61/298,701, filed Jan. 27, 2010, the entirety of which is incorporated herein by reference.

This application claims the benefit of U.S. Provisional Patent Application No. 61/299,154, filed Jan. 28, 2010, the entirety of which is incorporated herein by reference.

This application claims the benefit of U.S. Provisional Patent Application No. 61/299,183, filed Jan. 28, 2010, the entirety of which is incorporated herein by reference.

This application claims the benefit of U.S. Provisional Patent Application No. 61/299,634, filed Jan. 29, 2010, the entirety of which is incorporated herein by reference.

FIELD OF THE INVENTIVE SUBJECT MATTER

The present inventive subject matter is directed to lighting devices that comprise one or more multi-chip light emitters, e.g., multi-chip solid state light emitters. The present inventive subject matter is also directed to solid state light emitter support members and to lighting elements.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes have typical lifetimes between 50,000 and 70,000 hours. Fluorescent bulbs generally have lifetimes that are longer than those of incandescent lights (e.g., some fluorescent bulbs have reported lifetimes of 10,000-20,000 hours), but they typically provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

The color of visible light output by a light emitter, and/or the color of blended visible light output by a plurality of light emitters can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular hue. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

The expression "hue", as used herein, means light that has a color shade and saturation that correspond to a specific point on a CIE Chromaticity Diagram, i.e., a point that can be characterized with x,y coordinates on the 1931 CIE Chromaticity Diagram or with u', v' coordinates on the 1976 CIE Chromaticity Diagram.

In the 1931 Diagram, deviation from a point on the Diagram (i.e., "color point" or hue) can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses). A typical human eye is able to differentiate between hues that are spaced from each other by more than seven MacAdam ellipses (but is not able to differentiate between hues that are spaced from each other by seven or fewer MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent.

A series of points that is commonly represented on the CIF Diagrams is referred to as the blackbody locus. The chromaticity coordinates (i.e., color points) that lie along the blackbody locus obey Planck's equation: $E(\lambda)=A\lambda^{-5}/(e^{(B/T)}-1)$, where E is the emission intensity, λ is the emission wavelength, T is the color temperature of the blackbody and A and B are constants. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants that produce light that is on or near the blackbody locus can thus be described in terms of their color temperature.

The emission spectrum of any particular light emitting diode is typically concentrated around a single wavelength (as dictated by the light emitting diode's composition and structure), which is desirable for some applications, but not desirable for others, (e.g., for providing general illumination, such an emission spectrum provides a very low CRI Ra).

In many situations (e.g., lighting devices used for general illuminations), the color of light output that is desired differs from the color of light that is output from a single solid state light emitter, and so in many of such situations, combinations of two or more types of solid state light emitters that emit light of different hues are employed. Where such combinations are used, there is often a desire for the light output from the lighting device to have a particular degree of uniformity, i.e., to reduce the variance of the color of light emitted by the lighting device at a particular minimum distance or distances. For example, there may be a desire for "pixelation", the existence of visually perceptible differences in hues in the output light, to be reduced or eliminated at a particular distance (e.g., 18 inches) from a lighting device (e.g., by holding up a sheet of white paper and seeing whether different hues can be perceived), i.e., for adequate mixing of the light emitted by emitters that emit light of different hues to be achieved.

The most common type of general illumination is white light (or near white light), i.e., light that is close to the blackbody locus, e.g., within about 10 MacAdam ellipses of the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint; also, if the light having a correlated color temperature of 1500 K or less is excluded, the very red light along the blackbody locus is excluded.

Because light that is perceived as white is necessarily a blend of light of two or more colors (or wavelengths), no single light emitting diode junction has been developed that can produce white light.

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light.

While there is a need for more efficient white lighting, there is in general a need for more efficient lighting in all hues.

There is therefore a need for high efficiency light sources that combines the efficiency and long life of solid state light emitters with good color mixing.

BRIEF SUMMARY

In one aspect of the present inventive subject matter, there is provided a lighting device that comprises at least first and second multi-chip light emitters.

The expression "multi-chip light emitter", as used herein (e.g., in the expression "first and second multi-chip light emitters"), encompasses:

(1) a group of at least two solid state light emitters, in which each of the solid state light emitters in the group is spaced from at least one of the other solid state light emitters in the group by not more than the largest dimension of one of the solid state light emitters in that group (i.e., for each solid state light emitter, the minimum distance between one point on the solid state light emitter and one point on another (or the other) solid state light emitter in the group is not larger than the largest distance between two points on one of the solid state light emitters in the group);

(2) a group of at least two solid state light emitters, in which the largest distance between any point on a solid state light emitter in a first group and a point on another (or the other) solid state light emitter in that group is not more than about 50 percent (and in some cases, not more than about 40 percent, 30 percent, 20 percent, 10 percent, 5 percent or 2 percent) of a distance between a solid state light emitter in the first group and a solid state light emitter in a second group of at least two solid state light emitters; and (3) a group of at least two solid state light emitters, in which at least 50 percent (and in some cases, at least 60 percent, 70 percent, 80 percent, 90 percent, 95 percent or 98 percent) of light emitted by the solid state light emitters in the group pass through a first lens (e.g., a TIR lens).

A multi-chip light emitter can consist of (or can consist essentially of) two or more solid state light emitters, or it can comprise two or more solid state light emitters (e.g., it can include two or more solid state light emitters and may optionally also comprise a solid state light emitter support member on which the two or more solid state light emitters are mounted (and optionally one or more other structures))

In some embodiments of lighting devices of the present inventive subject matter, one or more solid state light emitters in each of at least two multi-chip light emitters contained in the lighting device emit light of respective hues that are within seven MacAdams ellipses, i.e., that are indistinguishable by the typical human eye.

It has been found that surprisingly effective color mixing (and hence surprisingly good color uniformity of emitted light beam) can be achieved by spatially offsetting one or more multi-chip light emitters such that solid state light emitters on different light emitters that emit light of respective hues that are within seven MacAdams ellipses of each other are oriented differently relative to the other solid state light emitters on the respective multi-chip light emitters.

In some embodiments of lighting devices of the present inventive subject matter, two or more multi-chip light emitters have similar layouts but at least one of the multi-chip light emitters is offset relative to one or more other multi-chip light emitters, e.g., by rotating (for example, by 180 degrees, or by 90 degrees, or to any other degree of rotation) one or more of the multi-chip light emitters about an axis substantially perpendicular to an emission surface.

In some embodiments, one or more collimating total internal reflection (TIR) lenses can be employed, and the benefits in color mixing provided by the present inventive subject matter are exceptional because lenslets provided on the surface of the lenses do not, by themselves, achieve adequate color mixing, but offsetting multi-chip light emitters as described herein enables excellent color mixing to be achieved.

In another aspect of the present inventive subject matter, there is provided a lighting device that comprises:

at least a first multi-chip light emitter and a second multi-chip light emitter, the first multi-chip light emitter comprising at least a first solid state light emitter and a second solid state light emitter, the second multi-chip light emitter comprising at least a third solid state light emitter and a fourth solid state light emitter, the first solid state light emitter emitting light of a first hue, the second solid state light emitter emitting light of a second hue, the third solid state light emitter emitting light of a third hue, the fourth solid state light emitter emitting light of a fourth hue, the first hue differing from the third hue by fewer MacAdam ellipses than the number of MacAdam ellipses by which:

the first hue differs from the second hue, the first hue differs from the fourth hue, the second hue differs from the third hue, the second hue differs from the fourth hue, or the third hue differs from the fourth hue, the first solid state light emitter being spatially offset (defined herein) relative to the third solid state light emitter by at least 10 degrees.

In some of such embodiments, which can include or not include, as suitable, any of the other features described herein, each of the first, second, third and fourth multi-chip light emitters have similar layouts.

In another aspect of the present inventive subject matter, there is provided a lighting device that comprises:

at least a first multi-chip light emitter, a second multi-chip light emitter and a third multi-chip light emitter, the first multi-chip light emitter comprising at least a first solid state light emitter, a second solid state light emitter, a third solid state light emitter and a fourth solid state light emitter, the second multi-chip light emitter comprising at least a fifth solid state light emitter, a sixth solid state light emitter, a seventh solid state light emitter and an eighth solid state light emitter, the third multi-chip light emitter comprising at least a ninth solid state light emitter, a tenth solid state light emitter, an eleventh solid state light emitter and a twelfth solid state light emitter the first solid state light emitter emitting light of a first hue, the second solid state light emitter emitting light of a second hue, the fifth solid state light emitter emitting light of a fifth hue, the sixth solid state light emitter emitting light of a sixth hue, the ninth solid state light emitter emitting light of a ninth hue, the tenth solid state light emitter emitting light of a tenth hue, the first hue differing from the fifth hue by not more than seven MacAdam ellipses, the first hue differing from the ninth hue by not more than seven MacAdam ellipses, the fifth hue differing from the ninth hue by not more than seven MacAdam ellipses, the first hue differing from each of the second hue, the sixth hue and the tenth hue by more than seven MacAdam ellipses, the fifth hue differing from each of the second hue, the sixth hue and the tenth hue by more than seven MacAdam ellipses, the ninth hue differing from each of the second hue, the sixth hue and the tenth hue by more than seven MacAdam ellipses, any solid state light emitter in the second multi-chip light emitter that is spatially offset relative to the first solid state light emitter by less than 10 degrees having a hue that differs from the first hue by more than seven MacAdam ellipses.

In another aspect of the present inventive subject matter, there is provided a solid state light emitter support member comprising:

a first region, and at least first, second and third protrusions extending from the first region, a first radius extending from a center of gravity of the solid state light emitter support member and along the first protrusion, a second radius extending from the center of gravity of the solid state light emitter support member and along the second protrusion, and a third radius extending from the center of gravity of the solid state light emitter support member and along the third protrusion each being at least 30 percent longer than each of:

a fourth radius extending from the center of gravity of the solid state light emitter support member to a first location on an edge of the solid state light emitter support member, the first location between the first protrusion and the second protrusion, a fifth radius extending from the center of gravity of the solid state light emitter support member to a second location on the edge of the solid state light emitter support member, the second location between the second protrusion and the third protrusion, and a sixth radius extending from the center of gravity of the solid state light emitter support member to a third location on the edge of the solid state light emitter support member, the third location between the third protrusion and the first protrusion.

Such a solid state light emitter support member can be especially useful in constructing lighting devices according to the present inventive subject matter.

In another aspect of the present inventive subject matter, there is provided a lighting device that comprises:

at least a first housing member, and means for emitting substantially uniform light.

The inventive subject matter may be more fully understood with reference to the accompanying drawings and the following detailed description of the inventive subject matter.

BRIEF DESCRIPTION OF THE DRAWING FIGURES

DETAILED DESCRIPTION

Figure 1:
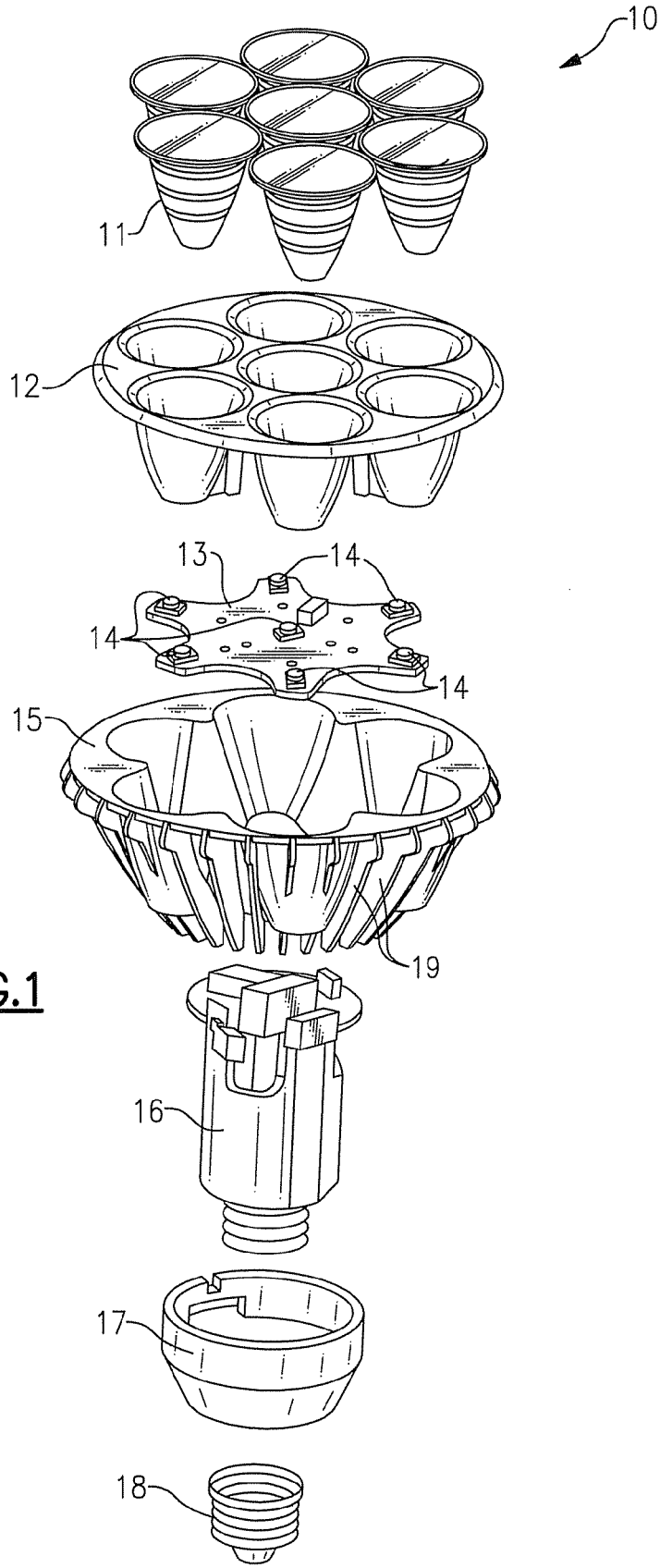
FIG. 1 is an exploded view of components of a lighting device 10.

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below. The expressions "top", "middle" and "bottom" are used herein to describe arrays of components in a structure if the structure were in an upright orientation, with "top row" referring to a row (of components in the array) that would be above other rows in the array, "bottom row" referring to a row (of components in the array) that would be below other rows in the array, and "middle row" referring to one or more rows between the top row and the bottom row.

The expression "illumination" (or "illuminated"), as used herein when referring to a solid state light emitter, means that at least some current is being supplied to the solid state light emitter to cause the solid state light emitter to emit at least some electromagnetic radiation (e.g., visible light). The expression "illuminated" encompasses situations where the solid state light emitter emits electromagnetic radiation continuously, or intermittently at a rate such that a human eye would perceive it as emitting electromagnetic radiation continuously or intermittently, or where a plurality of solid state light emitters of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "adjacent", as used herein to refer to a spatial relationship between a first structure and a second structure, means that the first and second structures are next to each other. That is, where the structures that are described as being "adjacent" to one another are similar, no other similar structure is positioned between the first structure and the second structure (for example, where two dissipation elements are adjacent to each other, no other dissipation element is positioned between them). Where the structures that are described as being "adjacent" to one another are not similar, no other structure is positioned between them.

The expression "defined (at least in part)", e.g., as used in the expression "mixing chamber is defined (at least in part) by a mixing chamber element" means that the element or feature that is defined "at least in part" by a particular structure is defined completely by that structure or is defined by that structure in combination with one or more additional structures.

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The word "surface", as used herein (e.g., in the expression "one or more solid state light emitters can be mounted on a first surface of a solid state light emitter support member"), encompasses regions that are flat or substantially flat, as well as regions that are not substantially flat, but for which at least 70% of the surface area of the region fits between first and second planes that are parallel to each other and are spaced from each other by a distance that is not more than 50% of a largest dimension of the region, and for which there are not two or more sub-regions within the region that (1) each comprise at least 5% of the surface area of the region, (2) at least 85% of the surface area of a first sub-region fits between third and fourth planes that are parallel to each other and are spaced from each other by a distance that is not more than 25% of a largest dimension of the first sub-region, and (3) at least 85% of the surface area of a second sub-region fits between fifth and sixth planes that (i) are parallel to each other, (ii) are spaced from each other by a distance that is not more than 25% of a largest dimension of the second sub-region, and (iii) define and angle of at least 30 degrees relative to the third and fourth planes.

The expression "BSY solid state light emitter", as used herein, means a solid state light emitter that emits light having x, y color coordinates which define a point which is within (1) an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53

The expression "substantially uniform light", as used herein, means that if a surface area of a beam of light (at a distance, along an axis that is perpendicular to the emission plane (defined below) of the lighting device, of six times a diameter of a surface of the lighting device from which light is emitted) were divided into 100 substantially square regions (except for regions on the border of the beam) of equal surface area, the hue of each region would differ from the hue of each other region by not more than seven MacAdam ellipses.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in an aspect of the present inventive subject matter, there is provided a lighting device that comprises at least a first multi-chip light emitter and a second multi-chip light emitter, the first multi-chip light emitter comprising at least a first solid state light emitter and a second solid state light emitter, the second multi-chip light emitter comprising at least a third solid state light emitter and a fourth solid state light emitter.

In some of such embodiments, which can include or not include, as suitable, any of the other features described herein, the first solid state light emitter is spatially offset relative to the third solid state light emitter by at least 10 degrees.

The expression "spatially offset by" at least a specified angle, as used herein (e.g., in the expression "the first solid state light emitter being spatially offset by at least 10 degrees relative to the third solid state light emitter") means that (1) a first multi-chip light emitter (that is "spatially offset" relative to a second multi-chip light emitter) and the second multi-chip light emitter have similar layouts (defined below), and the first multi-chip light emitter is rotated at least 10 degrees (about an axis substantially perpendicular to its emission plane) relative to the second multi-chip light emitter, or (2) if a first light emitter (that comprises a first solid state light emitter) were tilted (relative to a second light emitter that comprises a third solid state light emitter) a minimum amount (as measured by the angle of rotation of a plane defined by any three points in the first light emitter) necessary for the first light emitter to be in an orientation in which (A) a first plane that contains a first ray defined as extending from a center of gravity of the first light emitter (point 1) to a center of gravity of the first solid state light emitter (point 2), is parallel to (B) a second plane that contains a second ray defined as extending from a center of gravity of the second light emitter (point 3) to a center of gravity of the third solid state light emitter (point 4), the direction of the first ray (i.e., a ray defined as extending from point 1 to point 2) would differ from the direction of the second ray (i.e., a ray defined as extending from point 3 to point 4) by at least the specified angle.

In other words, in the second definition set forth in the preceding paragraph, with regard (for example) to a device in which a center of gravity of a first light emitter (that comprises a first solid state light emitter) and a center of gravity of the first solid state light emitter are in a first plane, a center of gravity of a second light emitter (that comprises a third solid state light emitter) and a center of gravity of the third solid state light emitter are in a second plane, and the first plane is co-planar with the second plane, no tilting would be necessary for the first plane (that contains a first ray defined as extending from a center of gravity of the first light emitter to a center of gravity of the first solid state light emitter) to be parallel to a second plane (that contains a second ray defined as extending from a center of gravity of the second light emitter to a center of gravity of the third solid state light emitter), and the first ray (i.e., a ray extending from the center of gravity of the first light emitter to the center of gravity of the first solid state light emitter) would define an angle of at least the specified angle (e.g., at least 10 degrees) relative to the second ray (i.e., a ray extending from a center of gravity of the second light emitter to a center of gravity of the third solid state light emitter).

On the other hand, (again with respect to the second definition of "spatially offset", set forth above) with regard (for example) to a device in which a substantially planar first light emitter (that comprises a first solid state light emitter) and a substantially planar second light emitter (that comprises a third solid state light emitter) are mounted on a partial-sphere-shaped housing (i.e., the shape that would be obtained by shearing off part of a sphere), spaced from each other (e.g., spaced one eighth of the sphere (i.e., 45 degrees), or one twelfth of the sphere (i.e., 30 degrees)), before determining an angle defined by the first ray (i.e., a ray extending from the center of gravity of the first light emitter to the center of gravity of the first solid state light emitter) relative to the second ray (i.e., a ray extending from a center of gravity of the second light emitter to the center of gravity of the third solid state light emitter), a the first light emitter would first have to be conceptually tilted (relative to the second light emitter) the minimum amount necessary to be in an orientation in which a first plane (that contains a first ray extending from the center of gravity of the first light emitter to the center of gravity of the first solid state light emitter) could be defined which is parallel to a plane (i.e., a second plane) that could be defined that contains the second ray (i.e., a ray extending from a center of gravity of the second light emitter to the center of gravity of the third solid state light emitter), and then the angle defined by the first ray relative to the second ray could be measured and compared with the minimum specified angle.

The following discussion of multi-chip light emitters applies to multi-chip light emitters that can be included in any of the lighting devices according to the present inventive subject matter.

A multi-chip light emitter comprises two or more solid state light emitters arranged in any suitable way. As noted above, a multi-chip light emitter can consist of (or can consist essentially of) two or more solid state light emitters, or it can comprise two or more solid state light emitters (e.g., it can include two or more solid state light emitters and may optionally also comprise a solid state light emitter support member (or plural support members) on which the two or more solid state light emitters are mounted (and optionally one or more other structures)). With regard to a multi-chip light emitter that comprises one or more solid state light emitter support members, the solid state light emitter support member (or members) can be made of any suitable material and can be of any suitable shape. Persons of skill in the art are familiar with a variety of materials (and combinations of materials) out of which such a solid state light emitter support member can be made, and shapes in which such a support member can be formed, and any such materials (and combinations of materials) and shapes can be employed in embodiments that include one or more solid state light emitter support members. Any such solid state light emitter support member can, if desired, include electrical contacts and/or conductive regions. In some embodiments in which one or more solid state light emitter support members are provided, the support member (or members) can be a circuit board(s) (e.g., a metal core circuit board or an FR4 board with thermal vias).

In some embodiments, two or more multi-chip light emitters can be mounted on a single solid state light emitter support member. In such embodiments, the solid state light emitter support member (or members) can be as described above. In some embodiments, for example, all of the multi-chip light emitters contained in a lighting device can be mounted on a single solid state light emitter support member.

As noted above, in an aspect of the present inventive subject matter, there is provided a solid state light emitter support member that comprises a first region and protrusions extending from the first region.

In some embodiments according to this aspect of the present inventive subject matter, the first region of such a support member can consist of or comprise a center region of the support member.

Embodiments according to this aspect of the present inventive subject matter can comprise any suitable number of protrusions.

In some embodiments according to this aspect of the present inventive subject matter, respective radii extending from the center of gravity of the solid state light emitter support member and along at least one of the protrusions can be at least 30 percent longer (and in some embodiments at least 40 percent longer, at least 50 percent longer, at least 60 percent longer or more) than at least one of the radii extending from the center of gravity of the solid state light emitter support member location on an edge of the solid state light emitter support member between two of the protrusions.

The present inventive subject matter also provides lighting elements that comprise a solid state light emitter support member that comprises a first region and protrusions extending from the first region and at least one multi-chip light emitter mounted on at least one of the protrusions. In some of such embodiments of lighting elements, a multi-chip light emitter can be mounted on each of the protrusions (and in some of such embodiments, two or more multi-chip light emitters can have similar layouts).

Multi-chip light emitters can be configured to emit (when supplied with electricity) light of any suitable hue or hues. For example, in some embodiments, one or more multi-chip light emitters can emit light that, when mixed, is perceived as white light. In some embodiments, one or more multi-chip light emitters can emit light that is blue, green, yellow, orange, red, or any other color or hue.

In some embodiments of lighting devices according to the present inventive subject matter, each of the multi-chip light emitters in the lighting device is configured to emit (when supplied with electricity) light that, when mixed, is of substantially the same hue (e.g., within seven MacAdams ellipses of a particular hue, and in some embodiments, within six, five, four, three, two or one MacAdams ellipse). In some embodiments of lighting devices according to the present inventive subject matter, at least one of the multi-chip light emitters in the lighting device is configured to emit (when supplied with electricity) light that, when mixed, is of a hue that differs from the hue of light (when mixed) that is emitted by at least one of the other multi-chip light emitters.

Any desired combination of solid state light emitters can be included in any of the multi-chip light emitters. For instance, in some embodiments, one or more of the multi-chip light emitters can comprise three BSY solid state light emitters and one red solid state light emitter (e.g., one or more multi-chip light emitters can include only those four solid state light emitters (and optionally other structure, but no other solid state light emitters)). The expression "red solid state light emitter", as used herein, means a solid state light emitter that emits red light (that is, wherever herein a solid state light emitter is referred to in terms of a color, the solid state light emitter is being identified as a solid state light emitter that, when supplied with electricity, emits light of that color). In some embodiments, one or more of the multi-chip light emitters can comprise:

two BSY solid state light emitters and two red solid state light emitters (e.g., one or more multi-chip light emitters can include only those four solid state light emitters);

one red solid state light emitter, two green solid state light emitters and one blue solid state light emitter (e.g., one or more multi-chip light emitters can include only those four solid state light emitters); or one red solid state light emitter, one green solid state light emitter, one blue solid state light emitter and one white solid state light emitter (e.g., one or more multi-chip light emitters can include only those four solid state light emitters).

Any multi-chip light emitter (or emitters) can similarly comprise any other combination of solid state light emitters and number of solid state light emitters (e.g., two, three, four, six, nine, twenty-five, fifty, one hundred solid state light emitters, etc.), which can be arranged in any suitable pattern).

In some embodiments, solid state light emitters in one or more multi-chip light emitters are arranged in a 2×2 array, a 2×3 array, a 3×3 array, etc. In some embodiments, a multi-chip light emitter can be associated with a circular or substantially circular region of a lighting device (or plural multi-chip light emitters can be associated with plural circular or substantially circular regions of a lighting device), which may bear on the suitability of a particular array of solid state light emitters (e.g., an array including a 3×3 arrangement of solid state light emitters, with an additional solid state light emitter substantially in the middle of each side of the array (i.e., thirteen solid state light emitters in total) might be suitable for use in a circular region that has a diameter slightly larger than five times the width of each solid state light emitter, or a 3×3 arrangement of solid state light emitters with a single additional solid state light emitter next to each solid state light emitter on the outside of the 3×3 arrangement (i.e., 21 solid state light emitters in total, with a top row including three solid state light emitters, three middle rows each including five solid state light emitters and a bottom row including three solid state light emitters) might be suitable for use in a circular region that is a bit larger still.

Each solid state light emitter can be oriented in any suitable way, e.g., each of the solid state light emitters in a multi-chip light emitter can be oriented such that each of their light emitting surfaces are parallel to each other (or are co-planar), or any of such solid state light emitters can be oriented such that its light emitting surface is oriented in some other way (i.e., not parallel or co-planar to one or more light emitting surfaces of other solid state light emitters in the multi-chip light emitter.

Any suitable combination of multi-chip light emitters, and any suitable number of multi-chip light emitters (e.g., two, three, four, six, nine, twenty-five or more, fifty or more, one hundred or more multi-chip light emitter) can be employed in lighting devices according to the present inventive subject matter, and the multi-chip light emitters can be arranged in any suitable pattern).

Figure 3:
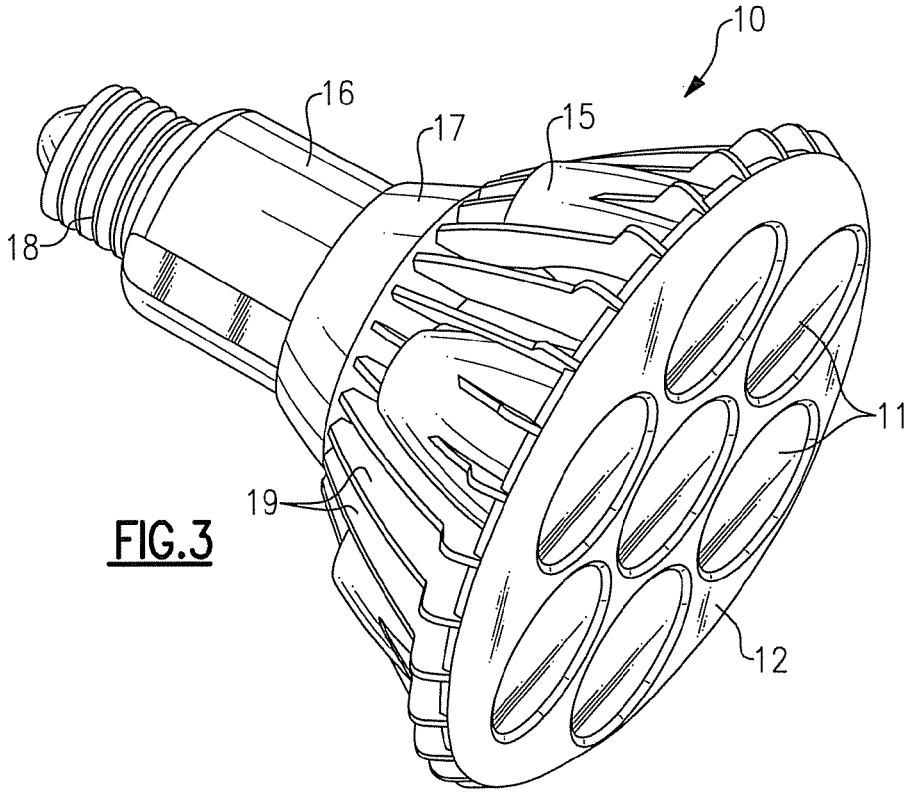
FIG. 3 is a perspective view of the lighting device 10.

In some embodiments, a multi-chip light emitter can be associated with a circular or substantially circular region of a lighting device (e.g., a circular light emitting surface), which may bear on the suitability of a particular array of multi-chip light emitters (e.g., an array including a top row of two multi-chip light emitters, a middle row of three multi-chip light emitters and a bottom row of two multi-chip light emitters (such an arrangement is depicted in FIGS. 1 and 3).

In some embodiments, there is provided a lighting device that comprises at least a first multi-chip light emitter and a second multi-chip light emitter, the first multi-chip light emitter comprising at least a first solid state light emitter and a second solid state light emitter, the second multi-chip light emitter comprising at least a third solid state light emitter and a fourth solid state light emitter, the first solid state light emitter emitting light of a first hue, the second solid state light emitter emitting light of a second hue, the third solid state light emitter emitting light of a third hue, the fourth solid state light emitter emitting light of a fourth hue, the first hue differs from the third hue by not more than seven MacAdam ellipses (e.g., by six MacAdam ellipses, or by five, four, three, two, one or zero MacAdam ellipses), the first hue differs from the second hue by more than seven MacAdam ellipses (e.g., by, ten MacAdam ellipses, or by fifteen, twenty, twenty-five, thirty or more MacAdam ellipses), the first hue differs from the fourth hue by more than seven MacAdam ellipses (e.g., by, ten MacAdam ellipses, or by fifteen, twenty, twenty-five, thirty or more MacAdam ellipses), the second hue differs from the third hue by more than seven MacAdam ellipses (e.g., by, ten MacAdam ellipses, or by fifteen, twenty, twenty-five, thirty or more MacAdam ellipses), the second hue differs from the fourth hue by more than seven MacAdam ellipses (e.g., by, ten MacAdam ellipses, or by fifteen, twenty, twenty-five, thirty or more MacAdam ellipses), and the third hue differs from the fourth hue by more than seven MacAdam ellipses (e.g., by, ten MacAdam ellipses, or by fifteen, twenty, twenty-five, thirty or more MacAdam ellipses).

In some embodiments, there is provided a lighting device that comprises two or more multi-chip light emitters that each have a similar layout, and that each have at least first and second solid state light emitters, in which the first solid state light emitter emits light of a hue that differs from a hue emitted by at least the second solid state light emitter by at least seven MacAdam ellipses.

The expression "similar layout", as used herein (e.g., in the expression "in some embodiments, two or more multi-chip light emitters can be provided which have similar layouts"), means that each multi-chip light emitter that is characterized as having a similar layout could be oriented such that:

in the case of multi-chip light emitters that each have two solid state light emitters:

a ray defined from a center of gravity of the multi-chip light emitter to the center of gravity of a first solid state light emitter defines a direction that is within 10 degrees of a first direction, a ray defined from a center of gravity of the multi-chip light emitter to the center of gravity of a second solid state light emitter defines a direction that is within 10 degrees of a second direction, a ray defined from a center of gravity of the first solid state light emitter to the center of gravity of the second solid state light emitter defines a direction that is within 10 degrees of a third direction, the first solid state light emitter for each multi-chip light emitter emits light of a hue differs by not more than seven MacAdams ellipses from a hue emitted by the first solid state light emitter for each of the other multi-chip light emitters in the lighting device, and the second solid state light emitter for each multi-chip light emitter emits light of a hue differs by not more than seven MacAdams ellipses from a hue emitted by the second solid state light emitter for each of the other multi-chip light emitters in the lighting device, in the case of multi-chip light emitters that each have three solid state light emitters:

a ray defined from a center of gravity of the multi-chip light emitter to the center of gravity of a first solid state light emitter defines a direction that is within 10 degrees of a first direction, a ray defined from a center of gravity of the multi-chip light emitter to the center of gravity of a second solid state light emitter defines a direction that is within 10 degrees of a second direction, a ray defined from a center of gravity of the multi-chip light emitter to the center of gravity of a third solid state light emitter defines a direction that is within 10 degrees of a third direction, a ray defined from a center of gravity of the first solid state light emitter to the center of gravity of the second solid state light emitter defines a direction that is within 10 degrees of a fourth direction, a ray defined from a center of gravity of the first solid state light emitter to the center of gravity of the third solid state light emitter defines a direction that is within 10 degrees of a fifth direction, a ray defined from a center of gravity of the second solid state light emitter to the center of gravity of the third solid state light emitter defines a direction that is within 10 degrees of a sixth direction, a distance from a center of gravity of the first solid state light emitter to a center of gravity of the second solid state light emitter is within 10 percent of a first distance, a distance from a center of gravity of the first solid state light emitter to a center of gravity of the third solid state light emitter is within 10 percent of a second distance, a distance from a center of gravity of the second solid state light emitter to a center of gravity of the third solid state light emitter is within 10 percent of a third distance, the first solid state light emitter for each multi-chip light emitter emits light of a hue differs by not more than seven MacAdams ellipses from a hue emitted by the first solid state light emitter for each of the other multi-chip light emitters in the lighting device, the second solid state light emitter for each multi-chip light emitter emits light of a hue differs by not more than seven MacAdams ellipses from a hue emitted by the second solid state light emitter for each of the other multi-chip light emitters in the lighting device, and the third solid state light emitter for each multi-chip light emitter emits light of a hue differs by not more than seven MacAdams ellipses from a hue emitted by the third solid state light emitter for each of the other multi-chip light emitters in the lighting device, in the case of multi-chip light emitters that each have four solid state light emitters:

a ray defined from a center of gravity of the multi-chip light emitter to the center of gravity of a first solid state light emitter defines a direction that is within 10 degrees of a first direction, a ray defined from a center of gravity of the multi-chip light emitter to the center of gravity of a second solid state light emitter defines a direction that is within 10 degrees of a second direction, a ray defined from a center of gravity of the multi-chip light emitter to the center of gravity of a third solid state light emitter defines a direction that is within 10 degrees of a third direction, a ray defined from a center of gravity of the multi-chip light emitter to the center of gravity of a fourth solid state light emitter defines a direction that is within 10 degrees of a fourth direction, a ray defined from a center of gravity of the first solid state light emitter to the center of gravity of the second solid state light emitter defines a direction that is within 10 degrees of a fifth direction, a ray defined from a center of gravity of the first solid state light emitter to the center of gravity of the third solid state light emitter defines a direction that is within 10 degrees of a sixth direction, a ray defined from a center of gravity of the first solid state light emitter to the center of gravity of the fourth solid state light emitter defines a direction that is within 10 degrees of a seventh direction, a ray defined from a center of gravity of the second solid state light emitter to the center of gravity of the third solid state light emitter defines a direction that is within 10 degrees of an eighth direction, a ray defined from a center of gravity of the second solid state light emitter to the center of gravity of the fourth solid state light emitter defines a direction that is within 10 degrees of a ninth direction, a ray defined from a center of gravity of the third solid state light emitter to the center of gravity of the fourth solid state light emitter defines a direction that is within 10 degrees of a tenth direction, a distance from a center of gravity of the first solid state light emitter to a center of gravity of the second solid state light emitter is within 10 percent of a first distance, a distance from a center of gravity of the first solid state light emitter to a center of gravity of the third solid state light emitter is within 10 percent of a second distance, a distance from a center of gravity of the first solid state light emitter to a center of gravity of the fourth solid state light emitter is within 10 percent of a third distance, a distance from a center of gravity of the second solid state light emitter to a center of gravity of the third solid state light emitter is within 10 percent of a fourth distance, a distance from a center of gravity of the second solid state light emitter to a center of gravity of the fourth solid state light emitter is within 10 percent of a fifth distance, a distance from a center of gravity of the third solid state light emitter to a center of gravity of the fourth solid state light emitter is within 10 percent of a sixth distance, the first solid state light emitter for each multi-chip light emitter emits light of a hue differs by not more than seven MacAdams ellipses from a hue emitted by the first solid state light emitter for each of the other multi-chip light emitters in the lighting device, the second solid state light emitter for each multi-chip light emitter emits light of a hue differs by not more than seven MacAdams ellipses from a hue emitted by the second solid state light emitter for each of the other multi-chip light emitters in the lighting device, the third solid state light emitter for each multi-chip light emitter emits light of a hue differs by not more than seven MacAdams ellipses from a hue emitted by the third solid state light emitter for each of the other multi-chip light emitters in the lighting device, and the fourth solid state light emitter for each multi-chip light emitter emits light of a hue differs by not more than seven MacAdams ellipses from a hue emitted by the fourth solid state light emitter for each of the other multi-chip light emitters in the lighting device, and so on for multi-chip light emitters that each have five, six, seven, eight, nine or more solid state light emitters.

The expression "could be oriented" in the definition of "similar layout" set forth above means that in determining whether two or more multi-chip light emitters are of similar layout, one or more of the multi-chip light emitters can be conceptually tilted and/or rotated (to different respective degrees) in determining whether they satisfy the features listed above for qualifying as multi-chip light emitters that are of similar layout. For instance, a collection of identical multi-chip light emitters (i.e., having identical solid state light emitters arranged in identical patterns on each of the multi-chip light emitters) "could be oriented" (rotated and/or tilted) so as to satisfy all of the features listed above even if they were all randomly mounted on different portions of a sphere (or jumbled in a variety of orientations in a box).

As noted above, in an aspect of the present inventive subject matter, there is provided a lighting device that comprises:

at least a first multi-chip light emitter, a second multi-chip light emitter and a third multi-chip light emitter, the first multi-chip light emitter comprising at least a first solid state light emitter, a second solid state light emitter, a third solid state light emitter and a fourth solid state light emitter, the second multi-chip light emitter comprising at least a fifth solid state light emitter, a sixth solid state light emitter, a seventh solid state light emitter and an eighth solid state light emitter, the third multi-chip light emitter comprising at least a ninth solid state light emitter, a tenth solid state light emitter, an eleventh solid state light emitter and a twelfth solid state light emitter the first solid state light emitter emitting light of a first hue, the second solid state light emitter emitting light of a second hue, the fifth solid state light emitter emitting light of a fifth hue, the sixth solid state light emitter emitting light of a sixth hue, the ninth solid state light emitter emitting light of a ninth hue, the tenth solid state light emitter emitting light of a tenth hue, the first hue differing from the fifth hue by not more than seven MacAdam ellipses, the first hue differing from the ninth hue by not more than seven MacAdam ellipses, the fifth hue differing from the ninth hue by not more than seven MacAdam ellipses, the first hue differing from each of the second hue, the sixth hue and the tenth hue by more than seven MacAdam ellipses, the fifth hue differing from each of the second hue, the sixth hue and the tenth hue by more than seven MacAdam ellipses, the ninth hue differing from each of the second hue, the sixth hue and the tenth hue by more than seven MacAdam ellipses, any solid state light emitter in the second multi-chip light emitter that is spatially offset relative to the first solid state light emitter by less than 10 degrees having a hue that differs from the first hue by more than seven MacAdam ellipses.

In some embodiments according to this aspect of the present inventive subject matter, any solid state light emitter in the second multi-chip light emitter that is spatially offset relative to the first solid state light emitter by less than 80 degrees (and in some embodiments by less than 70 degrees, or in some embodiments by less than 60, 50, 40, 30 or 20 degrees) has a hue that differs from the first hue by more than seven MacAdam ellipses.

In some embodiments according to this aspect of the present inventive subject matter, the lighting device comprises at least four multi-chip light emitters that have similar layouts, and in some of such embodiments, the fifth solid state light emitter is spatially offset by about 90 degrees (or in some embodiments by about 180 degrees) relative to the first solid state light emitter.

Multi-chip light emitters can be supported in any suitable way, and can be oriented in any suitable way. As noted above one or more multi-chip light emitters can be mounted on one or more solid state light emitter support member (e.g., all of the multi-chip light emitters in a lighting device can be mounted on a single solid state light emitter support member, each multi-chip light emitter in a lighting device can be mounted on a separate solid state light emitter support member (which can in turn be mounted on any suitable support structure or structures), or any number of multi-chip light emitters can be supported on any number of solid state light emitter support members).

Each respective multi-chip light emitters can be oriented in any suitable way, e.g., each multi-chip light emitter can be oriented such that its emission plane is parallel to the emission plane of one or more (or all) other multi-chip light emitter, or any of such multi-chip light emitters can be oriented such that its emission plane is oriented in some other way (i.e., not parallel or co-planar to the emission plane (or emission planes) of one or more other multi-chip light emitters.

The expression "emission plane" (e.g., "emission plane of one or more (or all) other multi-chip light emitter"), as used herein, means (1) a plane that is perpendicular to an axis of the light emission from the multi-chip light emitter (e.g., in a case where light emission is hemispherical, the plane would be along the flat part of the hemisphere; in a case where light emission is conical, the plane would be perpendicular to the axis of the cone), (2) a plane that is perpendicular to a direction of maximum intensity of light emission from the multi-chip light emitter (e.g., in a case where the maximum light emission is vertical, the plane would be horizontal), (3) a plane that is perpendicular to a mean direction of light emission (in other words, if the maximum intensity is in a first direction, but an intensity in a second direction ten degrees to one side of the first direction is larger than an intensity in a third direction ten degrees to an opposite side of the first direction, the mean intensity would be moved somewhat toward the second direction as a result of the intensities in the second direction and the third direction).

In some embodiments, one or more multi-chip light emitters (or at least one solid state light emitter), and/or a solid state light emitter support member (or at least one of plural solid state light emitter support members) can be removable.

The term "removable", as used herein, means that the element (e.g., one or more multi-chip light emitters, one or more solid state light emitter, or a solid state light emitter support member or members) that is characterized as being removable can be removed from the lighting device without structurally changing any component in the remainder of the lighting device, e.g., a multi-chip light emitter (or two or more multi-chip light emitters) can be removed from the lighting device and replaced with a replacement multi-chip light emitter (or two or more replacement multi-chip light emitters), without soldering, gluing, cutting, fracturing, etc., (and in some embodiments without the need for any tools) so that the lighting device with the replacement multi-chip light emitters) is structurally substantially identical to the lighting device with the previous multi-chip light emitter(s) except for the multi-chip light emitter(s) (or, if the replacement multi-chip light emitters) is substantially identical to the previous multi-chip light emitter(s), the entirety of the lighting device with the replacement multi-chip light emitter(s) is structurally substantially identical to the entirety of the lighting device with the previous multi-chip light emitter(s)).

In embodiments in which one or more multi-chip light emitters (or at least one solid state light emitter), and/or a solid state light emitter support member (or at least one of plural solid state light emitter support members) is/are removable, various advantages may be attainable. For instance, by providing for the ability to replace the one or more multi-chip light emitters (or at least one solid state light emitter), and/or a solid state light emitter support member (or at least one of plural solid state light emitter support members), one or more solid state light emitters can be operated at higher temperatures (recognizing that such higher temperatures may reduce the life-expectancy of the solid state light emitter(s), but that such solid state light emitter(s) can be replaced, if necessary), which may make it possible to obtain greater lumen output from the lighting device (which can enable a reduction in initial equipment cost because fewer lighting devices are needed to provide a particular combined lumen output), and/or to reduce or even minimize heat dissipation transfer and/or dissipation structure(s) in the lighting device.

The following discussion of solid state light emitters applies to the solid state light emitters that can be included in any of the multi-chip light emitters or lighting devices according to the present inventive subject matter.

Persons of skill in the art are familiar with, and have ready access to, a wide variety of solid state light emitters, and any suitable solid state light emitter (or solid state light emitters) can be employed in the multi-chip light emitters or lighting devices according to the present inventive subject matter. Representative examples of solid state light emitters include light emitting diodes (inorganic or organic, including polymer light emitting diodes (PLEDs)) with or without luminescent materials.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed.

The solid state light emitter in any lighting device according to the present inventive subject matter can be of any suitable size (or sizes), e.g., and any quantity (or respective quantities) of solid state light emitters of one or more sizes can be employed in the lighting device and/or in one or more multi-chip light emitters. In some instances, for example, a greater quantity of smaller solid state light emitters can be substituted for a smaller quantity of larger solid state light emitters, or vice-versa.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) and/or the type of electromagnetic radiation (e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Solid state light emitters according to the present inventive subject matter can, if desired, comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

Representative examples of suitable solid state light emitters, including suitable light emitting diodes and luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009-0296384), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

In general, light of any number of colors can be mixed by the lighting devices according to the present inventive subject matter. Representative examples of blending of light colors are described in:

U.S. patent application Ser. No. 11/613,714, filed Dec. 20, 2006 (now U.S. Patent Publication No. 2007/0139920), the entirety of which is hereby incorporated by reference as if set forth in its entirety;

U.S. patent application Ser. No. 11/613,733, filed Dec. 20, 2006 (now U.S. Patent Publication No. 2007/0137074) the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/736,799, filed Apr. 18, 2007 (now U.S. Patent Publication No. 2007/0267983), the entirety of which is hereby incorporated by reference as if set forth in its entirety;

U.S. patent application Ser. No. 11/737,321, filed Apr. 19, 2007 (now U.S. Patent Publication No. 2007/0278503), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 12/117,122, filed May 8, 2008 (now U.S. Patent Publication No. 2008/0304260), the entirety of which is hereby incorporated by reference as if set forth in its entirety;

U.S. patent application Ser. No. 12/117,131, filed May 8, 2008 (now U.S. Patent Publication No. 2008/0278940), the entirety of which is hereby incorporated by reference as if set forth in its entirety;

U.S. patent application Ser. No. 12/117,136, filed May 8, 2008 (now U.S. Patent Publication No. 2008/0278928), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. patent application Ser. No. 60/868,134, filed on Dec. 1, 2006, entitled "LIGHTING DEVICE AND LIGHTING METIIOD" (inventors: Antony Paul van de Ven and Gerald H. Negley), the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as i f set forth in its entirety;

U.S. patent application Ser. No. 12/475,850, filed on Jun. 1, 2009 (now U.S. Patent Publication No. 2009-0296384), the entirety of which is hereby incorporated by reference as if set forth in its entirety;

U.S. patent application Ser. No. 12/248,220, filed on Oct. 9, 2008 (now U.S. Patent Publication No. 2009/0184616), the entirety of which is hereby incorporated by reference as if set forth in its entirety;

U.S. patent application Ser. No. 11/951,626, filed Dec. 6, 2007 (now U.S. Patent Publication No. 2008/0136313), the entirety of which is hereby incorporated by reference as if set forth in its entirety;

U.S. patent application Ser. No. 12/035,604, filed on Feb. 22, 2008 (now U.S. Patent Publication No. 2008/0259589), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety;

U.S. patent application Ser. No. 60/990,435, filed on Nov. 27, 2007, entitled "WARM WHITE ILLIJMINATION WITH HIGH CRI AND HIGH EFFICACY" (inventors: Antony Paul van de Ven and Gerald H. Negley), the entirety of which is hereby incorporated by reference as if set forth in its entirety;

U.S. patent application Ser. No. 12/535,319, filed on Aug. 4, 2009 (now U.S. Patent Publication No. 2011/0031894), the entirety of which is hereby incorporated by reference as if set forth in its entirety; and U.S. patent application Ser. No. 12/541,215, filed on Aug. 14, 2009 (now U.S. Patent Publication No. 2011/0037409), the entirety of which is hereby incorporated by reference as if set forth in its entirety.

Some embodiments according to the present inventive subject matter employ one or more multi-chip light emitters that comprise at least one solid state light emitter that, if energized, emits BSY light, and at least one solid state light emitter that, if energized, emits light that is not BSY light.

As noted above, solid state light emitters can be arranged in any suitable way.

Some embodiments according to the present inventive subject matter can include solid state light emitters that emit light of a first hue (e.g., light within the BSY range) and solid state light emitters that emit light of a second hue (e.g., that is not within the BSY range, such as red or reddish or reddish orange or orangish, or orange light), where each of the solid state light emitters that emit light that is not BSY light is surrounded by five or six solid state light emitters that emit BSY light.

Some embodiments according to the present inventive subject matter comprise a first group of one or more solid state light emitters that, if energized, emit BSY light, and a second group of one or more solid state light emitters that, if energized, emit light that is not BSY light, and an average distance between a center of each solid state light emitter in the first group and a closest point on an edge region of a multi-chip light emitter is smaller than an average distance between a center of each solid state light emitter in the second group and a closest point on an edge region of the multi-chip light emitter.

In some embodiments, solid state light emitters (e.g., where a first group includes solid state light emitters that emit non-BSY light, e.g., red, reddish, reddish-orange, orangish or orange light, and a second group includes solid state light emitters that emit BSY light) may be arranged pursuant to a guideline described below in paragraphs (1)-(5), or any combination of two or more thereof, to further promote mixing of light from solid state light emitters emitting different colors of light:

(1) an array that has groups of first and second solid state light emitters with the first group of solid state light emitters arranged so that no two of the first group solid state light emitters are directly next to one another in the array;

(2) an array that comprises a first group of solid state light emitters and one or more additional groups of solid state light emitters, the first group of solid state light emitters being arranged so that at least three solid state light emitters from the one or more additional groups is adjacent to each of the solid state light emitters in the first group;

(3) an array that comprises a first group of solid state light emitters and one or more additional groups of solid state light emitters, and the array is arranged so that less than fifty percent (50%), or as few as possible, of the solid state light emitters in the first group of solid state light emitters are on the perimeter of the array;

(4) an array that comprises a first group of solid state light emitters and one or more additional groups of solid state light emitters, and the first group of solid state light emitters is arranged so that no two solid state light emitters from the first group are directly next to one another in the array, and so that at least three solid state light emitters from the one or more additional groups is adjacent to each of the solid state light emitters in the first group; and/or (5) an array that is arranged so that no two solid state light emitters from the first group are directly next to one another in the array, fewer than fifty percent (50%) of the solid state light emitters in the first group of solid state light emitters are on the perimeter of the array, and at least three solid state light emitters from the one or more additional groups are adjacent to each of the solid state light emitters in the first group.

Arrays according to the present inventive subject matter can also be arranged other ways, and can have additional features, that promote color mixing. In some embodiments, solid state light emitters can be arranged so that they are tightly packed, which can further promote natural color mixing. The lighting device can also comprise different diffusers and reflectors to promote color mixing in the near field and in the far field.

Solid state light emitters can be mounted on solid state light emitter support members (or other structures) in any suitable way, e.g., by using chip on heat sink mounting techniques, by soldering (e.g., if the solid state light emitter support member comprises a metal core printed circuit board (MCPCB), flex circuit or even a standard PCB, such as an FR4 board), for example, solid state light emitters can be mounted using substrate techniques such as from Thermastrate Ltd of Northumberland, UK. If desired, the surface of the solid state light emitter support member and/or the one or more solid state light emitters can be machined or otherwise formed to be of matching topography so as to provide high heat sink surface area.

The following discussion of housing members applies to housing members that can be included in any of the lighting devices according to the present inventive subject matter.

A housing member (or one or more housing members) (if included) can be of any suitable shape and size, and can be made of any suitable material or materials. Persons of skill in the art are familiar with, and can envision, a wide variety of materials out of which a housing can be constructed (for example, a metal, a ceramic material, a plastic material with low thermal resistance, or combinations thereof), and a wide variety of shapes for such housings, and housings made of any of such materials and having any of such shapes can be employed in accordance with the present inventive subject matter. In some embodiments, particularly where a housing member provides or assists in providing heat transfer and/or heat dissipation, the housing member can be formed of spun aluminum, stamped aluminum, die cast aluminum, powder metallurgy formed aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material, aluminum nitride (AlN), silicon carbide (SiC), diamond, diamond-like carbon (DLC), metal alloys, and polymers mixed with ceramic or metal or metalloid particles.

One or more housing members can be provided in order to support and/or protect any of the components (or combinations of components) of the lighting devices according to the present inventive subject matter as described herein.

In some embodiments, a housing member (or one or more housing members) can comprise one or more heat dissipation regions, e.g., one or more heat dissipation fins and/or one or more heat dissipation pins, or any other structure that provides or enhances any suitable thermal management scheme.

In embodiments that comprise a solid state light emitter support member, the solid state light emitter support member (or at least one of plural solid state light emitter support members) can facilitate the transfer of heat to a heat dissipation structure (or structures) and/or can function as a heat sink and/or as a heat dissipation structure.

In some embodiments, which can include or not include, as suitable, any of the other features described herein, any component (or components) of a lighting device can comprise one or more heat dissipation structures, e.g., fins or pins.

Some embodiments of lighting devices according to the present inventive subject matter may have only passive cooling. On the other hand, some embodiments of lighting devices according to the present inventive subject matter can have active cooling (and can optionally also have one or more passive cooling features). The expression "active cooling" is used herein in a manner that is consistent with its common usage to refer to cooling that is achieved through the use of some form of energy, as opposed to "passive cooling", which is achieved without the use of energy (i.e., while energy is supplied to solid state light emitters, passive cooling is the cooling that would be achieved without the use of any component(s) that would require additional energy in order to function to provide additional cooling). In some embodiments of the present inventive subject matter, therefore, cooling is achieved with only passive cooling, while in other embodiments of the present inventive subject matter, active cooling is provided (and any of the features described herein that provide or enhance passive cooling can optionally be included).

In some embodiments, a housing member (or one or more housing members) and a mixing chamber element are integral.

In some embodiments, one or more housing members is/are shaped so that it/they can accommodate one or more multi-chip light emitters, and/or one or more solid state light emitter support members, and/or any of a variety of components or modules involved, e.g., in receiving current supplied to a lighting device, modifying the current (e.g., converting it from AC to DC and/or from one voltage to another voltage), and/or driving one or more solid state light emitters (e.g., illuminating one or more solid state light emitter intermittently and/or adjusting the current supplied to one or more solid state light emitters in response to a detected operating temperature of one or more solid state light emitter, a detected change in intensity or color of light output, a detected change in an ambient characteristic such as temperature or background light, a user command, etc., and/or a signal contained in the input power, such as a dimming signal in AC power supplied to the lighting device).

In some embodiments, which can include or not include, as suitable, any of the other features described herein, lighting devices (or lighting device elements) according to the present inventive subject matter can include any suitable thermal management solutions.

Lighting devices (and lighting device elements) according to the present inventive subject matter can employ any suitable heat dissipation scheme, a wide variety of which (e.g., one or more heat dissipation structures) are well known to persons skilled in the art and/or which can readily be envisioned by persons skilled in the art. Representative examples of heat dissipation schemes which might be suitable are described in:

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 12/411,905, filed on Mar. 26, 2009 (now U.S. Patent Publication No. 2010/0246177), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety;

U.S. patent application Ser. No. 12/551,921, filed on Sep. 1, 2009 (now U.S. Patent Publication No. 2011/0050070), the entirety of which is hereby incorporated by reference as if set forth in its entirety;

U.S. patent application Ser. No. 61/245,683, filed on Sep. 25, 2009, the entirety of which is hereby incorporated by reference as if set forth in its entirety;

U.S. patent application Ser. No. 61/245,685, filed on Sep. 25, 2009, the entirety of which is hereby incorporated by reference as if set forth in its entirety;

U.S. patent application Ser. No. 12/566,850, filed on Sep. 25, 2009 (now U.S. Patent Publication No. 2011/0074265), the entirety of which is hereby incorporated by reference as if set forth in its entirety;

U.S. patent application Ser. No. 12/582,206, filed on Oct. 20, 2009 (now U.S. Patent Publication No. 2011/0090686), the entirety of which is hereby incorporated by reference as if set forth in its entirety;

U.S. patent application Ser. No. 12/607,355, filed on Oct. 28, 2009 (now U.S. Patent Publication No. 2011/0089838), the entirety of which is hereby incorporated by reference as if set forth in its entirety; and U.S. patent application Ser. No. 12/683,886, filed on Jan. 7, 2010 (now U.S. Patent Publication No. 2011/0089830), the entirety of which is hereby incorporated by reference as if set forth in its entirety.

In embodiments where active cooling is provided, any type of active cooling can be employed, e.g., blowing or pushing (or assisting in blowing) an ambient fluid (such as air) across or near one or more heat dissipation elements or heat sinks, thermoelectric cooling, phase change cooling (including supplying energy for pumping and/or compressing fluid), liquid cooling (including supplying energy for pumping, e.g., water, liquid nitrogen or liquid helium), magnetoresistance, etc.

In some embodiments, which can include or not include, as suitable, any of the other features described herein, one or more heat spreaders can be provided in order to move heat away from one or more solid state light emitter support member to one or more heat sink regions and/or one or more heat dissipation regions, and/or the heat spreader can itself provide surface area from which heat can be dissipated. Persons of skill in the art are familiar with a variety of materials that would be suitable for use in making a heat spreader, and any of such materials (e.g., copper, aluminum, etc.) can be employed.

In some embodiments, which can include or not include, as suitable, any of the other features described herein, a heat spreader can be provided that is in contact with a first surface of a solid state light emitter support member, and one or more solid state light emitters can be mounted on a second surface of the solid state light emitter support member, the first surface and the second surface being on opposite sides of the solid state light emitter support member. In such embodiments, if desired, circuitry (e.g., a compensation circuit) can be provided and positioned in contact with such a heat spreader, e.g., a heat spreader can be located between a solid state light emitter support member and a compensation circuit, and/or a heat spreader can have a recess that opens to a surface of the heat spreader that is remote from a solid state light emitter support member, and a compensation circuit can be located within that recess.

Heat transfer from one structure or region of a lighting device (or lighting device element) to another can be enhanced (i.e., thermal resistivity can be reduced or minimized) using any suitable material or structure for doing so, a variety of which are known to persons of skill in the art, e.g., by means of chemical or physical bonding and/or by interposing a heat transfer aid such as a thermal pad, thermal grease, graphite sheets, etc.

In some embodiments according to the present inventive subject matter, a portion (or portions) of any module, element, or other component of a lighting device can comprise one or more thermal transfer region(s) that has/have an elevated heat conductivity (e.g., higher than the rest of that module, element or other component. A thermal transfer region (or regions) can be made of any suitable material, and can be of any suitable shape. Use of materials having higher heat conductivity in making the thermal transfer region(s) generally provides greater heat transfer, and use of thermal transfer region(s) of larger surface area and/or cross-sectional area generally provides greater heat transfer. Representative examples of materials that can be used to make the thermal transfer region(s), if provided, include metals, diamond, DLC, etc. Representative examples of shapes in which the thermal transfer region(s), if provided, can be formed include bars, slivers, slices, crossbars, wires and/or wire patterns. A thermal transfer region (or regions), if included, can also function as one or more pathways for carrying electricity, if desired.

In some embodiments, which can include or not include, as suitable, any of the other features described herein, a sensor (e.g., a temperature sensor, such as a thermistor) can be positioned in any suitable location, e.g., a temperature sensor (e.g., a thermistor) can be positioned in contact with a heat spreader, e.g., between the heat spreader and a compensation circuit).

Lighting devices or lighting device elements according to the present inventive subject matter can comprise one or more electrical connectors.

Various types of electrical connectors are well known to those skilled in the art, and any of such electrical connectors can be attached within (or attached to) the lighting devices according to the present inventive subject matter. Representative examples of suitable types of electrical connectors include wires (for splicing to a branch circuit), Edison plugs (i.e., Edison screw threads, which are receivable in Edison sockets) and GU24 pins (which are receivable in GU24 sockets). Other well known types of electrical connectors include 2-pin (round) GX5.3, can DC bay, 2-pin GY6.35, recessed single contact R7s, screw terminals, 4 inch leads, 1 inch ribbon leads, 6 inch flex leads, 2-pin GU4, 2-pin GU5.3, 2-pin G4, turn & lock GU7, GU10, G8, G9, 2-pin Pf, min screw E10, DC bay BA15d, min cand E11, med screw E26, mog screw E39, mogul bipost G38, ext. mog end pr GX16d, mod end pr GX16d and med skirted E26/50x39 (see https://www.gecatalogs.com/lighting/software/GELightingCatalogSetup.exe). In some embodiments, an electrical connector can be attached to at least one housing member.

An electrical connector, if included, can be electrically connected to one or more circuitry component, e.g., a power supply, an electrical contact region or element, and/or a circuit board (on which a plurality of solid state light emitters are mounted).

It would be especially desirable to provide a lighting device that comprises one or more solid state light emitters (and in which some or all of the light produced by the lighting device is generated by solid state light emitters), where the lighting device can be easily substituted (i.e., retrofitted or used in place of initially) for a conventional lighting device (e.g., an incandescent lighting device, a fluorescent lighting device or other conventional types of lighting devices), for example, a lighting device (that comprises one or more solid state light emitters) that can be engaged with the same socket that the conventional lighting device is engaged (a representative example being simply unscrewing an incandescent lighting device from an Edison socket and threading in the Edison socket, in place of the incandescent lighting device, a lighting device that comprises one or more solid state light emitters). In some aspects of the present inventive subject matter, such lighting devices are provided.

Some embodiments in accordance with the present inventive subject matter (which can include or not include any of the features described elsewhere herein) include one or more lenses, diffusers or light control elements. Persons of skill in the art are familiar with a wide variety of lenses, diffusers and light control elements, can readily envision a variety of materials out of which a lens, a diffuser, or a light control element can be made (e.g., polycarbonate materials, acrylic materials, fused silica, polystyrene, etc.), and are familiar with and/or can envision a wide variety of shapes that lenses, diffusers and light control elements can be. Any of such materials and/or shapes can be employed in a lens and/or a diffuser and/or a light control element in an embodiment that includes a lens and/or a diffuser and/or a light control element. As will be understood by persons skilled in the art, a lens or a diffuser or a light control element in a lighting device according to the present inventive subject matter can be selected to have any desired effect on incident light (or no effect), such as focusing, diffusing, altering the direction of emission from the lighting device (e.g., increasing the range of directions that light proceeds from the lighting device, such as bending light to travel below the emission plane of the solid state light emitters. Any such lens and/or diffuser and/or light control element can comprise one or more luminescent materials, e.g., one or more phosphor.

Representative examples of lenses that can be employed in accordance with the present inventive subject matter include total internal reflection (TIR) optics (e.g., available from Fraen SRL (www.fraensrl.com)). As is well know, in some instances, TIR optics comprise solid shapes (e.g., generally cone-shaped), formed of any suitable material or materials (e.g., clear acrylic material) designed to receive light at one end (e.g., at a rounded point of the cone), provide total internal reflection of a large portion of light that hits its sidewalls, and to collimate the light before it exits from the generally circular portion of the cone, where, if desired, as is well known, one or more lenslets can be provided to diffuse the light to some extent.

Additional representative examples of lenses that can be employed in lighting devices according to the present inventive subject matter are described in U.S. patent application Ser. No. 12/776,799, filed May 10, 2010 (now U.S. Patent Publication No. 2011-0273882, entitled "OPTICAL ELEMENT FOR A LIGIIT SOURCE AND LIGHTING SYSTEM USING SAME", discussed in more detail below, the entirety of which is hereby incorporated by reference as if set forth in its entirety.

In embodiments in accordance with the present inventive subject matter that include a lens (or plural lenses), the lens (or lenses) can be positioned in any suitable location and orientation.

In embodiments in accordance with the present inventive subject matter that include a diffuser (or plural diffusers), the diffuser (or diffusers) can be positioned in any suitable location and orientation. In some embodiments, which can include or not include any of the features described elsewhere herein, a diffuser can be provided over a top or any other part of the lighting device. A diffuser can be included in the form of a diffuser film/layer that is arranged to mix light emission from solid state light emitters in the near field. That is, a diffuser can mix the emission of solid state light emitters, such that when the lighting device is viewed directly, the light from the discrete solid state light emitters is not separately identifiable.

A diffuser film (if employed) can comprise any of many different structures and materials arranged in different ways, e.g., it can comprise a conformally arranged coating over a lens. In some embodiments, commercially available diffuser films can be used such as those provided by Bright View Technologies, Inc. of Morrisville, North Carolina, Fusion Optix, Inc. of Cambridge, Mass., or Luminit, Inc. of Torrance, Calif. Some of these films can comprise diffusing microstructures that can comprise random or ordered micro lenses or geometric features and can have various shapes and sizes. A diffuser film can be sized to fit over all or less than all of a lens, and can be bonded in place over a lens using known bonding materials and methods. For example, a film can be mounted to a lens with an adhesive, or could be film insert molded with a lens. In other embodiments, a diffuser film can comprise scattering particles, or can comprise index photonic features, alone or in combination with microstructures. A diffuser film can have any of a wide range of suitable thicknesses (some diffuser films are commercially available in a thickness in the range of from 0.005 inches to 0.125 inches, although films with other thicknesses can also be used).

In other embodiments, a diffuser and/or scattering pattern can be directly patterned onto a component, e.g., a lens. Such a pattern may, for example, be random or a pseudo pattern of surface elements that scatter or disperse light passing through them. The diffuser can also comprise microstructures within the component (e.g., lens), or a diffuser film can be included within the component (e.g., lens).

Diffusion and/or light scattering can also be provided or enhanced through the use of additives, a wide variety of which are well known to persons of skill in the art. Any of such additives can be contained in a lumiphor, in an encapsulant, and/or in any other suitable element or component of the lighting device.

In embodiments in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed. For example, representative light control elements are described in U.S. Patent Application No. 61/245,688, filed on Sep. 25, 2009, the entirety of which is hereby incorporated by reference as if set forth in its entirety. A light control element (or elements) can be any structure or feature that alters the overall nature of a pattern formed by light emitted by a light source. As such, the expression "light control element", as used herein, encompasses, e.g., films and lenses that comprise one or more volumetric light control structures and/or one or more surface light control features.

In addition, one or more scattering elements (e.g., layers) can optionally be included in the lighting devices according to the present inventive subject matter. For example, a scattering element can be included in a lumiphor (i.e., a transparent or translucent article in which luminescent material is embedded), and/or a separate scattering element can be provided. A wide variety of separate scattering elements are well known to those of skill in the art, and any such elements can be employed in the lighting devices of the present inventive subject matter. Scattering elements can be made from different materials, such as particles of titanium dioxide, alumina, silicon carbide, gallium nitride, or glass micro spheres, e.g., with the particles dispersed within a lens.

Persons of skill in the art are familiar with, and have ready access to, a wide variety of filters, and any suitable filter (or filters), or combinations of different types of filters, can be employed in accordance with the present inventive subject matter. Such filters can include (1) pass-through filters, i.e., filters in which light to be filtered is directed toward the filter, and some or all of the light passes through the filter (e.g., some of the light does not pass through the filter) and the light that passes through the filter is the filtered light, (2) reflection filters, i.e., filters in which light to be filtered is directed toward the filter, and some or all of the light is reflected by the filter (e.g., some of the light is not reflected by the filter) and the light that is reflected by the filter is the filtered light, and (3) filters that provide a combination of both pass-through filtering and reflection filtering.

Any desired circuitry, including any desired electronic components, can be employed in order to supply energy to one or more solid state light emitters according to the present inventive subject matter. Representative examples of circuitry which may be used in practicing the present inventive subject matter are described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

U.S. patent application Ser. No. 12/566,142, filed on Sep. 24, 2009, entitled "Solid State Lighting Apparatus With Configurable Shunts" (now U.S. Patent Publication No. 2011-0068696), the entirety of which is hereby incorporated by reference as if set forth in its entirety;

U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011-0068702), the entirety of which is hereby incorporated by reference as if set forth in its entirety.

For example, solid state lighting systems have been developed that include a power supply that receives AC line voltage and converts that voltage to a voltage (e.g., to DC and to a different voltage value) and/or current suitable for driving solid state light emitters. Power supplies for light emitting diode light sources can include any of a wide variety of electrical components, e.g., linear current regulated supplies and/or pulse width modulated current and/or voltage regulated supplies, and can include bridge rectifiers, transformers, power factor controllers etc.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Bergjohansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

Various electronic components (if provided in the lighting devices) can be mounted in any suitable way. For example, in some embodiments, light emitting diodes can be mounted on one or more solid state light emitter support member, and electronic circuitry that can convert AC line voltage into DC voltage suitable for being supplied to light emitting diodes can be mounted on a separate element (e.g., a "driver circuit board"), whereby line voltage is supplied to the electrical connector and passed along to a driver circuit board, the line voltage is converted to DC voltage suitable for being supplied to light emitting diodes in the driver circuit board, and the DC voltage is passed along to the solid state light emitter support member (or members) where it is then supplied to the light emitting diodes.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

Compensation circuits can be provided to help to ensure that the perceived color (including color temperature in the case of "white" light) of light exiting a lighting device is accurate (e.g., within a specific tolerance). Such compensation circuits, if included, can (for example) adjust the current supplied to solid state light emitters that emit light of one color and/or separately adjust the current supplied to solid state light emitters that emit light of a different color, so as to adjust the color of mixed light emitted from lighting devices, and such adjustment(s) can be (1) based on temperature sensed by one or more temperature sensors (if included), and/or (2) based on light emission as sensed by one or more light sensors (if included) (e.g., based on one or more sensors that detect (i) the color of the light being emitted from the lighting device, and/or (ii) the intensity of the light being emitted from one or more of the solid state light emitters, and/or (iii) the intensity of light of one or more specific hues of color), and/or based on any other sensors (if included), factors, phenomena, etc.

A wide variety of compensation circuits are known, and any can be employed in the lighting devices according to the present inventive subject matter. For example, a compensation circuit may comprise a digital controller, an analog controller or a combination of digital and analog. For example, a compensation circuit may comprise an application specific integrated circuit (ASIC), a microprocessor, a microcontroller, a collection of discrete components or combinations thereof. In some embodiments, a compensation circuit may be programmed to control one or more solid state light emitters. In some embodiments, control of one or more solid state light emitters may be provided by the circuit design of the compensation circuit and is, therefore, fixed at the time of manufacture. In still further embodiments, aspects of the compensation circuit, such as reference voltages, resistance values or the like, may be set at the time of manufacture so as to allow adjustment of the control of the one or more solid state light emitters without the need for programming or control code.

Representative examples of suitable compensation circuits are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011-0068702), the entirety of which is hereby incorporated by reference as if set forth in its entirety;

U.S. patent application Ser. No. 12/704,730, filed on Feb. 12, 2010, entitled "Solid State Lighting Apparatus With Compensation Bypass Circuits And Methods Of Operation Thereof", now U.S. Patent Publication No. 2011-0068701), the entirety of which is hereby incorporated by reference as if set forth in its entirety;

U.S. patent application Ser. No. 12/704,995, filed on Feb. 12, 2010 (now U.S. Patent Publication No. 2011/0198984), the entirety of which is hereby incorporated by reference as if set forth in its entirety; and U.S. patent application Ser. No. 61/312,918, filed on Mar. 11, 2010, the entirety of which is hereby incorporated by reference as if set forth in its entirety.

The following discussion of color sensors applies to color sensors that can be included in any of the lighting devices according to the present inventive subject matter.

Persons of skill in the art are familiar with a wide variety of color sensors, and any of such sensors can be employed in the lighting devices of the present inventive subject matter. Among these well known sensors are sensors that are sensitive to all visible light, as well as sensors that are sensitive to only a portion of visible light. For example, the sensor can be a unique and inexpensive sensor (GaP:N light emitting diode) that views the entire light flux but is only (optically) sensitive to one or more of a plurality of light emitting diodes. For instance, in one specific example, the sensor can be sensitive to only a particular range (or ranges) of wavelengths, and the sensor can provide feedback to one or more light sources (e.g., light emitting diodes that emit light of that color or that emit light of other colors) for color consistency as the light sources age (and light output decreases). By using a sensor that monitors output selectively (by color), the output of one color can be selectively controlled to maintain the proper ratios of outputs and thereby maintain the color output of the device. This type of sensor is excited by only light having wavelengths within a particular range, e.g., a range that excludes red light (see, e.g., U.S. patent application Ser. No. 12/117,280, filed May 8, 2008 (now U.S. Patent Publication No. 2008/0309255), the entirety of which is hereby incorporated by reference as if set forth in its entirety.

Other techniques for sensing changes in light output of light sources include providing separate or reference emitters and a sensor that measures the light output of these emitters. These reference emitters can be placed so as to be isolated from ambient light such that they typically do not contribute to the light output of the lighting device. Additional techniques for sensing the light output of a light source include measuring ambient light and light output of the lighting device separately and then compensating the measured light output of the light source based on the measured ambient light.

The following discussion of temperature sensors applies to temperature sensors that can be included in any of the lighting devices according to the present inventive subject matter.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to compensation circuitry, e.g., to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

In some embodiments, one or more temperature sensors (e.g., a single temperature sensor or a network of temperature sensors) can be provided which are in contact with one or more solid state light emitters (or on the surface of a solid state light emitter support member on which one or more solid state light emitters are mounted), or are positioned close to one or more solid state light emitters (e.g., less than ¼ inch away), such that the temperature sensor(s) provide accurate readings of the temperature of the solid state light emitter(s).

In some embodiments, one or more temperature sensors (e.g., a single temperature sensor or a network of temperature sensors) can be provided which are not in contact with one or more solid state light emitters, and are not positioned close to one or more solid state light emitters, but are positioned such that it (or they) is spaced from the solid state light emitter (or solid state light emitters) by only structure (or structures) having low thermal resistance, such that the temperature sensor(s) provide accurate readings of the temperature of the solid state light emitter(s).

In some embodiments, one or more temperature sensors (e.g., a single temperature sensor or a network of temperature sensors) can be provided which are not in contact with one or more solid state light emitters, and are not positioned close to one or more solid state light emitters, but the arrangement is such that the temperature at the temperature sensor(s) is proportional to the temperature at the solid state light emitter(s), or the temperature at the temperature sensor(s) varies in proportion to the variance of temperature at the solid state light emitter(s), or the temperature at the temperature sensor(s) is correlatable to the temperature at the solid state light emitter(s).

Some embodiments in accordance with the present inventive subject matter can comprise a power line that can be connected to a source of power (such as a branch circuit, an electrical outlet, a battery, a photovoltaic collector, etc.) and that can supply power to an electrical connector (or directly to an electrical contact, e.g., the power line itself can be an electrical connector). Persons of skill in the art are familiar with, and have ready access to, a variety of structures that can be used as a power line. A power line can be any structure that can carry electrical energy and supply it to an electrical connector on a lighting device and/or to a lighting device according to the present inventive subject matter.

Energy can be supplied to the lighting devices according to the present inventive subject matter from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

Lighting devices according to the present inventive subject matter can comprise one or more mixing chamber elements, one or more trim elements and/or one or more fixture elements.

A mixing chamber element (if included) can be of any suitable shape and size, and can be made of any suitable material or materials. Light emitted by one or more solid state light emitters can be mixed to a suitable extent in a mixing chamber before exiting the lighting device.

Representative examples of materials that can be used for making a mixing chamber element include, among a wide variety of other materials, spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments, a mixing chamber element can consist of or can comprise a reflective element (and/or one or more of its surfaces can be reflective). Such reflective elements (and surfaces) are well-known and readily available to persons skilled in the art. A representative example of a suitable material out of which a reflective element can be made is a material marketed by Furukawa (a Japanese corporation) under the trademark MCPET®.

In some embodiments, a mixing chamber is defined (at least in part) by a mixing chamber element. In some embodiments, a mixing chamber is defined in part by a mixing chamber element (and/or by a trim element) and in part by a lens and/or a diffuser.

In some embodiments, at least one trim element can be attached to a lighting device according to the present inventive subject matter. A trim element (if included) can be of any suitable shape and size, and can be made of any suitable material or materials. Representative examples of materials that can be used for making a trim element include, among a wide variety of other materials, spun aluminum, stamped aluminum, die cast aluminum, rolled or stamped steel, hydroformed aluminum, injection molded metal, iron, injection molded thermoplastic, compression molded or injection molded thermoset, glass (e.g., molded glass), ceramic, liquid crystal polymer, polyphenylene sulfide (PPS), clear or tinted acrylic (PMMA) sheet, cast or injection molded acrylic, thermoset bulk molded compound or other composite material. In some embodiments that include a trim element, the trim element can consist of or can comprise a reflective element (and/or one or more of its surfaces can be reflective). Such reflective elements (and surfaces) are well known and readily available to persons skilled in the art. A representative example of a suitable material out of which a reflective element can be made is a material marketed by Furukawa (a Japanese corporation) under the trademark MCPET®.

In some embodiments according to the present inventive subject matter, a mixing chamber element can be provided which comprises a trim element (e.g., a single structure can be provided which acts as a mixing chamber element and as a trim element, a mixing chamber element can be integral with a trim element, and/or a mixing chamber element can comprise a region that functions as a trim element). In some embodiments, such structure can also comprise some or all of a thermal management system for the lighting device. By providing such a structure, it is possible to reduce or minimize the thermal interfaces between the solid state light emitter(s) and the ambient environment (and thereby improve heat transfer), especially, in some cases, in devices in which a trim element acts as a heat sink for light source(s) (e.g., solid state light emitters) and is exposed to a room. In addition, such a structure can eliminate one or more assembly steps, and/or reduce parts count. In such lighting devices, the structure (i.e., the combined mixing chamber element and trim element) can further comprise one or more reflector and/or reflective film, with the structural aspects of the mixing chamber element being provided by the combined mixing chamber element and trim element).

In some embodiments, a lighting device (or lighting device element) according to the present inventive subject matter can be attached to at least one fixture element. A fixture element, when included, can comprise a fixture housing, a mounting structure, an enclosing structure, and/or any other suitable structure. Persons of skill in the art are familiar with, and can envision, a wide variety of materials out of which such fixture elements can be constructed, and a wide variety of shapes for such fixture elements. Fixture elements made of any of such materials and having any of such shapes can be employed in accordance with the present inventive subject matter.

For example, fixture elements, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. patent application Ser. No. 60/861,901, filed on Nov. 30, 2006, entitled "LED DOWNLIGHT WITH ACCESSORY ATTACIIMENT" (inventors: Gary David Trott, Paul Kenneth Pickard and Ed Adams), the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/467,467, filed on May 18, 2009 (now U.S. Patent Publication No. 2010/0290222), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/465,203, filed on May 13, 2009 (now U.S. Patent Publication No. 2010/0290208), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety;

U.S. patent application Ser. No. 12/566,936, filed on Sep. 25, 2009 (now U.S. Patent Publication No. 2011/0075423), the entirety of which is hereby incorporated by reference as if set forth in its entirety;

U.S. patent application Ser. No. 12/566,857, filed on Sep. 25, 2009 (now U.S. Patent Publication No. 2011/0075411), the entirety of which is hereby incorporated by reference as if set forth in its entirety;

U.S. patent application Ser. No. 12/621,970, filed on Nov. 19, 2009 (now U.S. Patent Publication No. 2011/0075414), the entirety of which is hereby incorporated by reference as if set forth in its entirety; and U.S. patent application Ser. No. 12/566,861, filed on Sep. 25, 2009 (now U.S. Patent Publication No. 2011/0075422), the entirety of which is hereby incorporated by reference as if set forth in its entirety.

In some embodiments, a fixture element, if provided, can further comprise an electrical connector that engages an electrical connector on the lighting device or that is electrically connected to the lighting device.

In some embodiments that include a fixture element, an electrical connector is provided that is substantially non-moving relative to the fixture element, e.g., the force normally employed when installing an Edison plug in an Edison socket does not cause the Edison socket to move more than one centimeter relative to the fixture element, and in some embodiments, not more than ½ centimeter (or not more than ¼ centimeter, or not more than one millimeter, etc.). In some embodiments, an electrical connector that engages an electrical connector on the lighting device can move relative to a fixture element, and structure can be provided to limit movement of the lighting device relative to the fixture element (e.g., as disclosed in U.S. patent application Ser. No. 11/877,038, filed Oct. 23, 2007 (now U.S. Patent Publication No. 2008/0106907), the entirety of which is hereby incorporated by reference as if set forth in its entirety).

In some embodiments, one or more structures can be attached to a lighting device that engage structure in a fixture element to hold the lighting device in place relative to the fixture element. In some embodiments, the lighting device can be biased against a fixture element, e.g., so that a flange portion of a trim element is maintained in contact (and forced against) a bottom region of a fixture element (e.g., a circular extremity of a cylindrical can light housing). Additional examples of structures that can be used to hold a lighting device in place relative to a fixture element are disclosed in U.S. patent application Ser. No. 11/877,038, filed Oct. 23, 2007 (now U.S. Patent Publication No. 2008/0106907), the entirety of which is hereby incorporated by reference as if set forth in its entirety).

The lighting devices of the present inventive subject matter can be arranged in generally any suitable orientation, a variety of which are well known to persons skilled in the art. For example, the lighting device can be a back-reflecting device or a front-emitting device.

Lighting devices according to the present inventive subject matter can be of any desired overall shape and size. In some embodiments, the lighting devices according to the present inventive subject matter are of size and shape (i.e., form factor) that correspond to any of the wide variety of light sources in existence, e.g., PAR lamps (e.g., PAR 30 lamps or PAR 38 lamps), A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc. Within each of the lamp types identified in the previous sentence, numerous different varieties (or an infinite number of varieties) exist. For example, a number of different varieties of conventional A lamps exist and include those identified as A 15 lamps, A 17 lamps, A 19 lamps, A 21 lamps and A 23 lamps. The expression "A lamp" as used herein includes any lamp that satisfies the dimensional characteristics for A lamps as defined in ANSI C78.20-2003, including the conventional A lamps identified in the preceding sentence. Some representative examples of form factors include mini Multi-Mirror® projection lamps, Multi-Mirror® projection lamps, reflector projection lamps, 2-pin-vented base reflector projection lamps, 4-pin base CBA projection lamps, 4-pin base BCK projection lamps, DAT/DAK DAY/DAK incandescent projection lamps, DEK/DFW/DHN incandescent projection lamps, CAR incandescent projection lamps CAZ/CZB incandescent projection lamps, CZX/DAB incandescent projection lamps, DDB incandescent projection lamps, DRB DRC incandescent projection lamps, DRS incandescent projection lamps, BLX BLC BNF incandescent projection lamps, CDD incandescent projection lamps, CRX/CBS incandescent projection lamps, BAH BBA BCA ECA standard photofloods, EBW ECT standard photofloods, EXV EXX EZK reflector photofloods, DXC EAL reflector photofloods, double-ended projection lamps, G-6 G5.3 projection lamps, G-7 G29.5 projection lamps, G-7 2 button projection lamps, T-4 GY6.35 projection lamps, DFN/DFC/DCH/DJA/DFP incandescent projection lamps, DLD/DFZ GX17q incandescent projection lamps, DJL G17q incandescent projection lamps, DPT mog base incandescent projection lamps, lamp shape B (B8 cand, B10 can, B13 med), lamp shape C (C7 cand, C7 DC bay), lamp shape CA (CA8 cand, CA9 med, CA10 cand, CA10 med), lamp shape G (G16.5 cand, G16.5 DC bay, G16.5 SC bay, G16.5 med, G25 med, G30 med, G30 med slat, G40 med, G40 mog) T6.5 DC bay, T8 disc (a single light engine module could be placed in one end, or a pair could be positioned one in each end), T6.5 inter, T8 med, lamp shape T (T4 cand, T4.5 cand, T6 cand, T6.5 DC bay, T7 cand, T7 DC bay, T7 inter, T8 cand, T8 DC bay, T8 inter, T8SC bay, T8 SC Pf, T10 med, T10 med Pf, T12 3C med, T14 med Pf, T20 mog bipost, T20 med bipost, T24 med bipost), lamp shape M (M14 med), lamp shape ER (ER30 med, ER39 med), lamp shape BR (BR30 med, BR40 med), lamp shape R (R14 SC bay, R14 inter, R20 med, R25 med, R30 med, R40 med, R40 med skrt, R40 mog, R52 mog), lamp shape P (P25 3C mog), lamp shape PS (PS25 3C mog, PS25 med, PS30 med, PS30 mog, PS35 mog, PS40 mog, PS40 mog Pf, PS52 mog), lamp shape PAR (PAR 20 med NP, PAR 30 med NP, PAR 36 scrw trim, PAR 38 skrt, PAR 38 med skrt, PAR38 med sid pr, PAR46 scrw PAR46 mog end pr, PAR46 med sid pr, PAR56 scrw trm, PAR56 mog end pr, PAR56 mog end pr, PAR64 scrw trm, PAR64 ex mog end pr). (see https://www.gecatalogs.com/lighting/software/GELightingCatalogSetup.exe) (with respect to each of the form factors, a light engine module can be positioned in any suitable location, e.g., with its axis coaxial with an axis of the form factor and in any suitable location relative to the respective electrical connector). The lamps according to the present inventive subject matter can satisfy (or not satisfy) any or all of the other characteristics for PAR lamps or for any other type of lamp.

Lighting devices in accordance with the present inventive subject matter can be designed to emit light in any suitable pattern, e.g., in the form of a flood light, a spotlight, a downlight, etc. Lighting devices according to the present inventive subject matter can comprise one or more light sources that emit light in any suitable pattern, or one or more light sources that emit light in each of a plurality of different patterns.

In many situations, the lifetime of solid state light emitters can be correlated to a thermal equilibrium temperature (e.g., junction temperatures of solid state light emitters). The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of the thermal management system of the lighting device (or lighting device element) is/are selected so as to extract heat from the solid state light emitters) and dissipate the extracted heat to a surrounding environment at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value).

Solid state light emitter lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

Various embodiments can be described with reference to "expected L70 lifetime."Because the lifetimes of solid state lighting products are measured in the tens of thousands of hours, it is generally impractical to perform full term testing to measure the lifetime of the product. Therefore, projections of lifetime from test data on the system and/or light source are used to project the lifetime of the system. Such testing methods include, but are not limited to, the lifetime projections found in the ENERGY STAR Program Requirements cited above or described by the ASSIST method of lifetime prediction, as described in "ASSIST Recommends . . . LED Life For General Lighting: Definition of Life", Volume 1, Issue 1, February 2005, the disclosure of which is hereby incorporated herein by reference as if set forth fully herein. Accordingly, the term "expected L70 lifetime" refers to the predicted L70 lifetime of a product as evidenced, for example, by the L70 lifetime projections of ENERGY STAR, ASSIST and/or a manufacturer's claims of lifetime.

Lighting devices according to some embodiments of the present inventive subject matter provide an expected L70 lifetime of at least 25,000 hours. Lighting devices according to some embodiments of the present inventive subject matter provide expected L70 lifetimes of at least 35,000 hours, and lighting devices according to some embodiments of the present inventive subject matter provide expected L70 lifetimes of at least 50,000 hours.

In some aspects of the present inventive subject matter, there are provided lighting devices that provide good efficiency and that are within the size and shape constraints of the lamp for which the lighting device is a replacement. In some embodiments of this type, there are provided lighting devices that provide lumen output of at least 600 lumens, and in some embodiments at least 750 lumens, at least 900 lumens, at least 1000 lumens, at least 1100 lumens, at least 1200 lumens, at least 1300 lumens, at least 1400 lumens, at least 1500 lumens, at least 1600 lumens, at least 1700 lumens, at least 1800 lumens (or in some cases at least even higher lumen outputs), and/or CRI Ra of at least 70, and in some embodiments at least 80, at least 85, at least 90 or at least 95).

In some aspects of the present inventive subject matter, which can include or not include any of the features described elsewhere herein, there are provided lighting devices that provide sufficient lumen output (to be useful as a replacement for a conventional lamp), that provide good efficiency and that are within the size and shape constraints of the lamp for which the lighting device is a replacement. In some cases, "sufficient lumen output" means at least 75% of the lumen output of the lamp for which the lighting device is a replacement, and in some cases, at least 85%, 90%, 95%, 100%, 105%, 110%, 115%, 120% or 125% of the lumen output of the lamp for which the lighting device is a replacement.

The color of the output from the lighting devices according to the present inventive subject matter can be any suitable color (including white) and/or color temperature and can comprise visible and/or non-visible light.

The lighting devices (or lighting device element) according to the present inventive subject matter can direct light in any desired range of directions. For instance, in some embodiments, the lighting device (or lighting device element) can direct light substantially omnidirectionally (i.e., substantially 100% of all directions extending from a center of the lighting device), i.e., within a volume defined by a two-dimensional shape in an x, y plane that encompasses rays extending from 0 degrees to 180 degrees relative to the y axis (i.e., 0 degrees extending from the origin along the positive y axis, 180 degrees extending from the origin along the negative y axis), the two-dimensional shape being rotated 360 degrees about the y axis (in some cases, the y axis can be a vertical axis of the lighting device). In some embodiments, the lighting device (or lighting device element) emits light substantially in all directions within a volume defined by a two-dimensional shape in an x, y plane that encompasses rays extending from 0 degrees to 150 degrees relative to the y axis (extending along a vertical axis of the lighting device), the two-dimensional shape being rotated 360 degrees about the y axis. In some embodiments, the lighting device (or lighting device element) emits light substantially in all directions within a volume defined by a two-dimensional shape in an x, y plane that encompasses rays extending from 0 degrees to 120 degrees relative to the y axis (extending along a vertical axis of the lighting device), the two-dimensional shape being rotated 360 degrees about the y axis. In some embodiments, the lighting device (or lighting device element) emits light substantially in all directions within a volume defined by a two-dimensional shape in an x, y plane that encompasses rays extending from 0 degrees to 90 degrees relative to the y axis (extending along a vertical axis of the lighting device), the two-dimensional shape being rotated 360 degrees about the y axis (i.e., a hemispherical region). In some embodiments, the two-dimensional shape can instead encompass rays extending from an angle in the range of from 0 to 30 degrees (or from 30 degrees to 60 degrees, or from 60 degrees to 90 degrees) to an angle in the range of from 90 to 120 degrees (or from 120 degrees to 150 degrees, or from 150 degrees to 180 degrees). In some embodiments, the range of directions in which the lighting device (or lighting device element) emits light can be non-symmetrical about any axis, i.e., different embodiments can have any suitable range of directions of light emission, which can be continuous or discontinuous (e.g., regions of ranges of emissions can be surrounded by regions of ranges in which light is not emitted). In some embodiments, the lighting device (or lighting device element) can emit light in at least 50% of all directions extending from a center of the lighting device (or lighting device element) (e.g., hemispherical being 50%), and in some embodiments at least 60%, 70%, 80%, 90% or more.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 2:
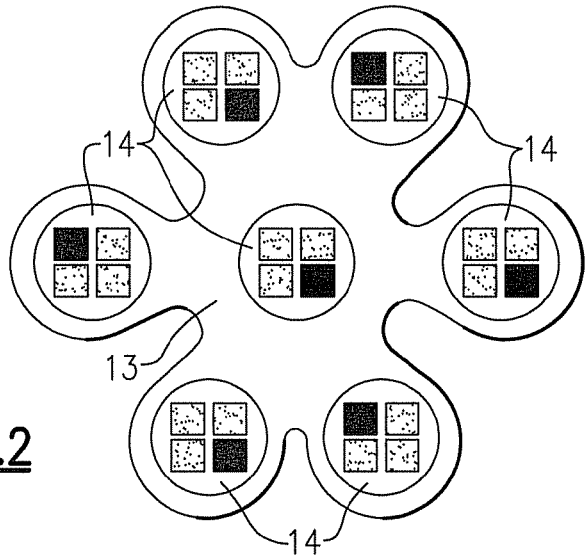
FIG. 2 is a top view of a lighting element that is included in the lighting device 10.

FIGS. 1-3 illustrate a lighting device 10 in accordance with the present inventive subject matter. FIG. 1 is an exploded view of components of the lighting device 10, FIG. 2 is a top view of a lighting element that is included in the lighting device 10 (the lighting element including a solid state light emitter support member 13 and a plurality of multi-chip light emitters 14 mounted on the solid state light emitter support member 13), and FIG. 3 is a perspective view of the lighting device 10.

Referring to FIG. 1, the lighting device 10 comprises a TIR optic 11, an optic positioning element 12, a solid state light emitter support member 13, a plurality of multi-chip light emitters 14, a first housing member 15, a second housing member 16, a third housing member 17, and an electrical connector 18. A heat spreader (e.g., a graphite heat spreader) (not shown) can be provided, e.g., between the solid state light emitter support member 13 and the first housing member 15, to assist in spreading heat emitted by the solid state light emitters across a greater amount of surface area of the first housing member 15.

The electrical connector 18 is supported on a bottom region of the second housing member 16 and is threadable into an Edison socket. (Alternatively, if desired, any other type of electrical connector can be provided.)

The second housing member 16 can be made of any suitable material (or materials), e.g., plastic, and power supply circuitry and driver circuitry are mounted on and/or in the second housing member 16 (if desired, compensation circuitry can also be provided in and/or on the second housing member 16).

The first housing member 15 provides structure that assists in establishing and maintaining proper positioning and orientation of the second housing member 16, the multi-chip light emitters 14 and the optic positioning element 12 relative to the first housing member 15 and to one another. The first housing member 15 also provides heat dissipation structure in the form of heat dissipation fins 19. The first housing member 15 can be made of any suitable material (or materials), e.g., aluminum.

The solid state light emitter support member 13 can be made of any suitable material (or materials). In some embodiments, the solid state light emitter support member 13 can be a metal core circuit board or an FR4 circuit board with thermal vias.

The multi-chip light emitters 14 can comprise any suitable solid state light emitters as described herein.

The optic positioning element 12 is provided to assist in establishing and maintaining proper positioning and orientation of the TER optic 11 relative to the multi-chip light emitters 14 (i.e., with each of the multi-chip light emitters 14 emitting light into the rounded point of one of the generally cone-shaped structures of the TER optic 11). The optic positioning element 12 can be made of any suitable material, e.g., plastic. In some embodiments, the optic positioning element 12 (or at least one or more portions thereof) can be white (or substantially white) in order to reflect light that may spill from the TIR optic 11. In some embodiments, the optic positioning element 12 (or at least one or more portions thereof) can be black (or substantially black) in order to absorb light that may spill from the TIR optic 11.

The third housing member 17 can be made of any suitable material, e.g., plastic. In some embodiments, the third housing member 17 can be removable (e.g., it can be removably snap-fitted to the first housing member 15) in order to provide for access to circuitry components in order to tune the color of light emission, to communicate with a driver, to adjust compensation circuitry, etc.).

Electricity is supplied to the lighting device 10 through the electrical connector 18, and is supplied from the electrical connector 18 to the power supply and driver (and, if included, compensation circuitry), which can interact in any suitable way to supply electricity to the solid state light emitters in the multi-chip light emitters 14, via conductive paths in the solid state light emitter support member 13, to illuminate and/or excite the solid state light emitters in any suitable way (e.g., electricity to one or more solid state light emitters can be pulsed and/or adjusted over time, different currents can be supplied to different solid state light emitters, etc.).

Light emitted by the solid state light emitters in the multi-chip light emitters 14 enters the TIR optic 11 and is collimated in the TIR optic 11 and then diffused to some extent as it passes through lenslets at the emission surfaces of the TIR optic 11.

FIG. 2 shows a plurality of multi-chip light emitters 14 mounted on the solid state light emitter support member 13. Each of the multi-chip light emitters 14 includes four solid state light emitters arranged in a 2×2 array, including three BSY solid state light emitters and one red solid state light emitter. As shown in FIG. 2, each of the multi-chip light emitters 14 has a similar layout (i.e., each of them could be oriented with the red solid state light emitter in the lower right and the three BSY solid state light emitters in the upper right, the upper left and the lower left), and three of the multi-chip light emitters 14 (namely, the multi-chip light emitter in the top row on the right side, the multi-chip light emitter in the middle row on the left side, and the multi-chip light emitter in the bottom row on the right side) are spatially offset by 180 degrees relative to the multi-chip light emitters 14 that are oriented with the red solid state light emitter in the lower right and the three BSY solid state light emitters in the upper right, the upper left and the lower left (i.e., the spatially offset multi-chip light emitters 14 have the red solid state light emitter in the upper left instead of the lower right).

FIG. 3 is a perspective view of the lighting device 10 as assembled.

Figure 4:
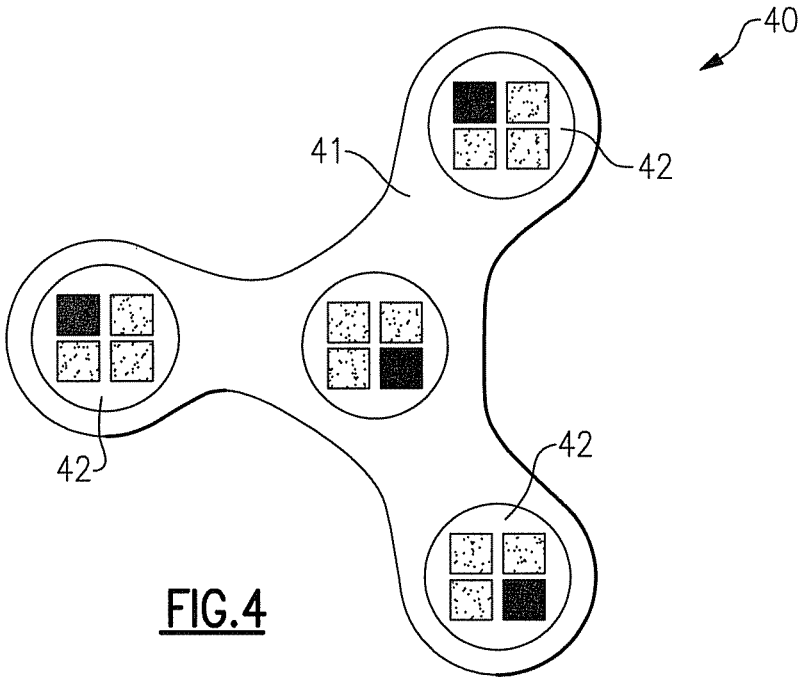
FIG. 4 shows an alternative lighting element 40.

FIG. 4 shows an alternative lighting element 40 that comprises a solid state light emitter support member 41 and a plurality of multi-chip light emitters 42. The multi-chip light emitters 42 are arranged in an array that differs from the array depicted in FIG. 3

Figure 5:
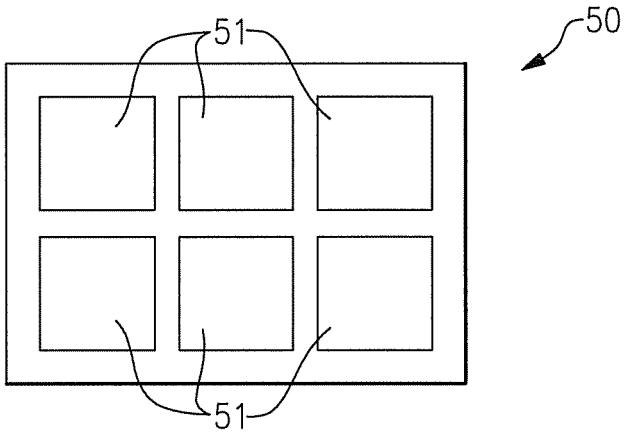
FIG. 5 shows an alternative multi-chip light emitter 50.

FIG. 5 shows an alternative multi-chip light emitter 50 that comprises six solid state light emitters 51 arranged in a 2×3 array.

Figure 6:
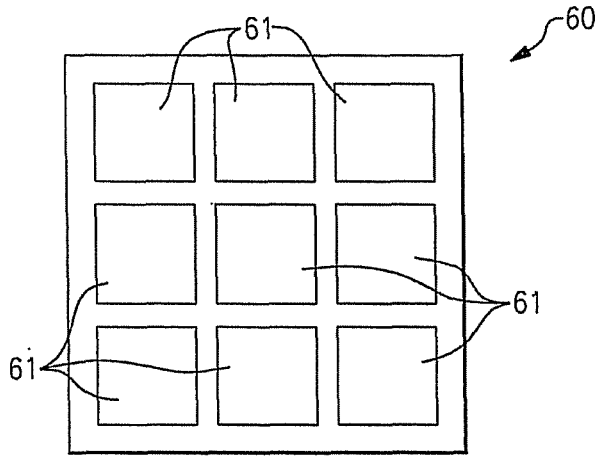
FIG. 6 shows an alternative multi-chip light emitter 60.

FIG. 6 shows an alternative multi-chip light emitter 60 that comprises nine solid state light emitters 61 arranged in a 3×3 array.

Figure 7:
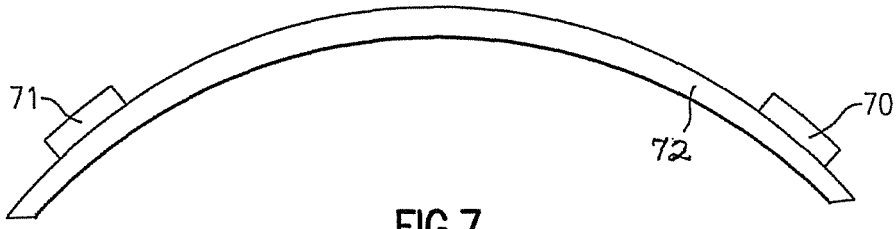
FIG. 7 is a schematic diagram showing a first multi-chip light emitter 70 and a second multi-chip light emitter 71.

FIG. 7 is a schematic diagram showing that a first multi-chip light emitter 70 and a second multi-chip light emitter 71 that have similar layouts can be not spatially offset from one another even though their respective emission planes are not co-planar or parallel (i.e., if they are mounted on different regions of a partial-sphere-shaped structure 72.

EXAMPLE

Tests were conducted using a Fraen optic and an Apollo lamp, and it was found that the orientation of the multi-chip light emitters (in a 2×2 array with three BSY solid state light emitters and one red solid state light emitter) with respect to each other had a significant impact on color uniformity.

Figure 8:
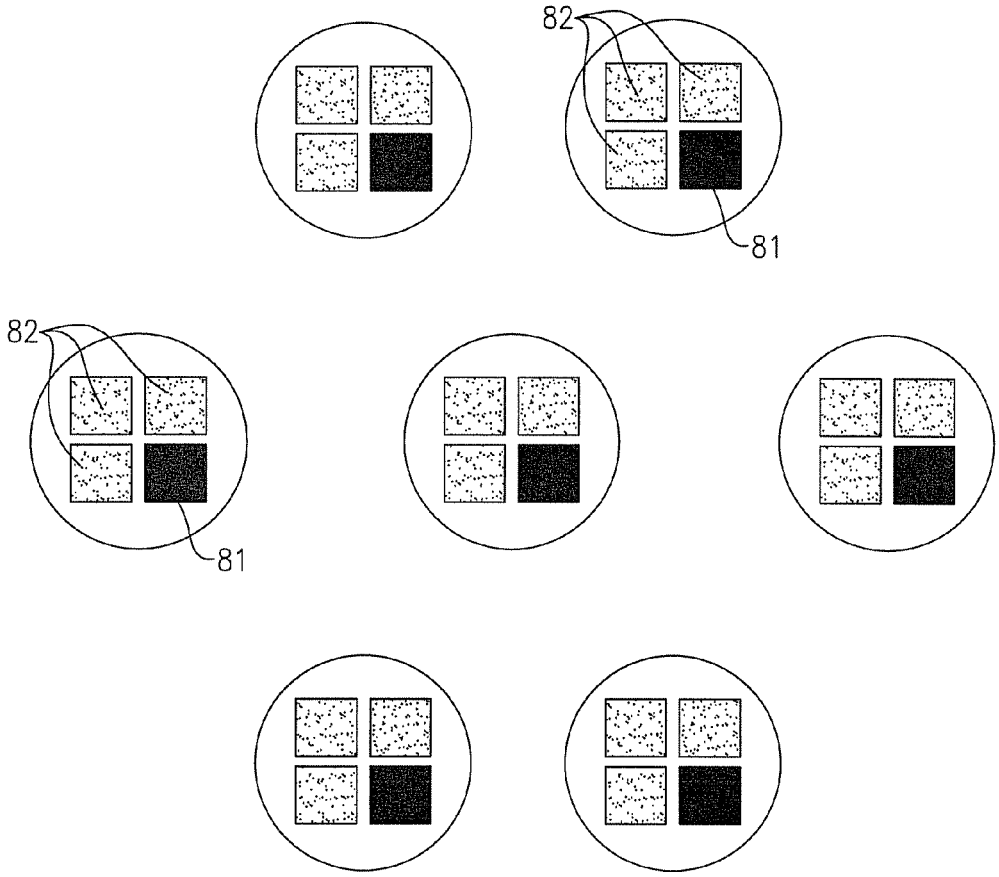
FIG. 8 shows an arrangement of a prototype with seven multi-chip light emitters that was used in an Example.

A first prototype assembled had seven multi-chip light emitters (arranged as depicted in FIG. 8), each with the red solid state light emitter 81 in the same spatial location in each multi-chip light emitter, namely, in the bottom right (and the BSY solid state light emitters 82 in the top right, bottom left and bottom right).

In this configuration, the beam exhibited a color non-uniformity that was clearly visible to the naked eye. However, by rotating at three out of the seven multi-chip light emitters (namely, the multi-chip light emitter in the top row on the right side, the multi-chip light emitter in the middle row on the left side, and the multi-chip light emitter in the bottom row on the right side) to locate the red in the opposite corner (i.e., the top left) of the multi-chip light emitters (i.e., to spatially offset those multi-chip light emitters, and therefore each of the solid state light emitters in those multi-chip light emitters, by 180 degrees), the uniformity was much improved.

The same effect was exhibited (to a lesser degree) when seven multi-chip light emitters that each included a 2×2 array (including two BSY solid state light emitters (upper left and lower right) and two red solid state light emitters (upper right and lower left)), were arranged in a way similar to as shown in FIG. 8 and in which the multi-chip light emitter in the top row on the right side, the multi-chip light emitter in the middle row on the left side, and the multi-chip light emitter in the bottom row on the right side were then spatially offset by 90 degrees.

A significant challenge to overcome with an optic as depicted in FIG. 1 is to provide a tight optical beam (e.g., 13 degrees or less) while utilizing a large number of solid state light emitters of at least two colors. An individual optic, used with a package with four light emitting diode chips, would provide color mixing that, for some purposes, would not be acceptable, regardless of the configuration, because the body of the optic is a collimating TIR lens—which is essentially an imaging optic. The body of the optic by itself would project images of light emitting diode chips on the work surface. The lenslets on the front face of the optic provide some level of homogenization, but not enough to provide color uniformity adequate for some purposes (i.e., less than seven MacAdams variance across the face of the beam). By utilizing multiple devices with multiple optics and offsetting some of the multi-chip light emitters with respect to each other, however, areas of red emphasis are overlapped with areas of yellow emphasis in order to allow for acceptable color uniformity in the far field. In a 2×2 configuration, the offset orientation provided a 1 MacAdam color shift or less across the face of the beam. This approach does not achieve near field mixing, i.e., separate colors can be seen on the face of each optic.

This practice can be applied equally to arrays of multi-chip light emitters that include other 2×2 arrays, e.g., arrays that include one red solid state light emitter, two green solid state light emitters, and one blue solid state light emitter (RGGB), and 2×2 arrays of one red solid state light emitter, one green solid state light emitter, one blue solid state light emitter and one white solid state light emitter (RGBW).

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices or light engine modules described herein can be provided in two or more parts (which may be held together in any known way, e.g., with adhesive, screws, bolts, rivets, staples, etc.).

As noted above, representative examples of lenses that can be employed in lighting devices according to the present inventive subject matter are described in U.S. patent application Ser. No. 12/776,799, filed May 10, 2010, entitled "OPTICAL ELEMENT FOR A LIGHT SOURCE AND LIGHTING SYSTEM USING SAME". The following is a discussion of subject matter described in that application.

Embodiments of the present inventive subject matter can include an optical element that can enable a lighting system to achieve beam control, and where necessary, effective mixing of light from multiple sources, e.g. color mixing. An optical element according to some embodiments can be useful where highly controlled beams of light are needed, for example, in track lighting, display lighting, and entertainment lighting. An optical element according to some embodiments can also be useful to provide various lighting effects.

In some embodiments of the inventive subject matter, an optical element can include an entry surface and an exit surface spaced from the entry surface. The entry surface includes at least three subsurfaces, wherein each subsurface is disposed to receive light rays from the light source (e.g., one or more multi-chip light emitters). Each of the three subsurfaces is geometrically shaped and positioned to direct light rays entering the optical element through that subsurface in order to direct light through the optical element. Thus, a first subsurface can direct a first portion of the light from the light source, a second subsurface can direct a second portion of light from the light source, and a third subsurface can direct a third portion of light from the light source. The optical element also includes an outer surface disposed between the exit surface and the entry surface. In some embodiments the outer surface is conic, including parabolic in shape.

In some embodiments, the subsurfaces include a spherical subsurface, a flat conic subsurface, and an inverted conic subsurface. In some embodiments, the subsurfaces include a flat subsurface, a spherical subsurface, and an inverted spherical subsurface. In some embodiments, the optical element includes a concentrator lens disposed in the exit surface. The concentrator lens can be, for example, a Fresnel lens or a spherical lens.

In some embodiments, the optical element includes a light mixing treatment. The light mixing treatment can be, for example, a diffractive surface treatment in the exit surface of the optical element. As additional examples, the light mixing treatment can also be a patterned lens treatment in the exit surface or faceting in the exit surface of the optical element. A light mixing treatment could also consist of or include faceting in the entry surface of the optical element or faceting in the outer surface of the optical element. The light mixing treatment could also be implemented by volumetric diffusion material spaced a small airgap away from the exit surface of the optical element. In some embodiments, the light mixing treatment provides mixing of different color light.

Figure 9:
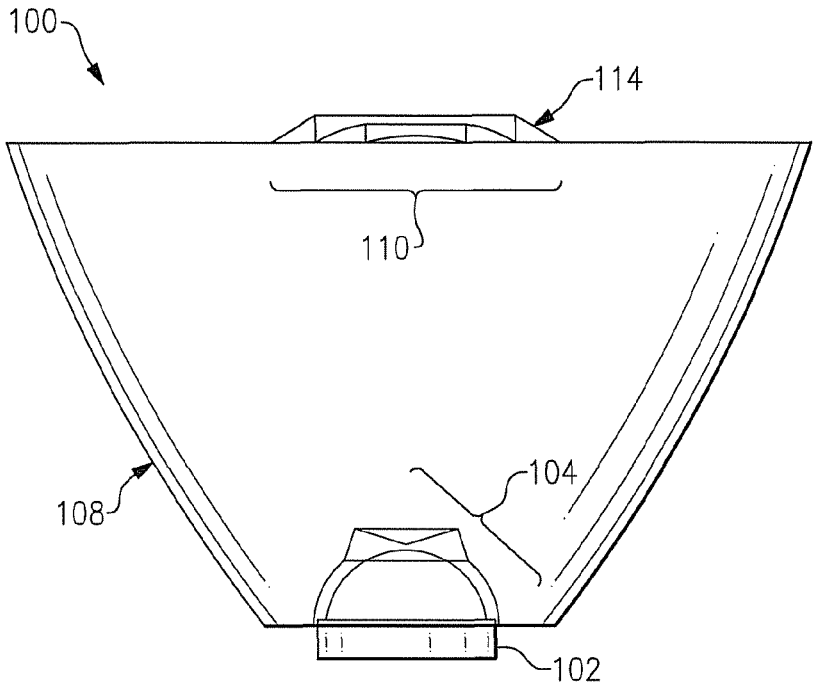
FIG. 9 shows a side view cross-section of an optical element that can be employed in lighting devices according to the present inventive subject matter.

FIG. 9 shows a side view cross-section of an optical element that can be employed in lighting devices according to the present inventive subject matter.

Optical element, or more simply, "optic" 100 is clear, and in this example, is made of material having an index of refraction of approximately 1.5. The refractive indices of glasses and plastics vary, with some materials having an index of refraction as low as 1.48 and some others, for example some polycarbonates having an index of refraction of 1.59. Such materials include glass and/or acrylic, both of which are commonly used in optical components. Optic 100 includes entry surface 104, which completely covers a lens portion of a multi-chip light emitter 102. Light enters the optic through entry surface 104. Light exits the optical element through exit surface 106, which is spaced from and positioned generally opposite entry surface 104. Exit surface 106 is round in shape, as will be apparent when it is observed from a different view in a finished lighting system in FIG. 16, which will be discussed later in this disclosure. In one example embodiment, the radius of the circle defining exit surface 106 is approximately 16 mm, and the height of the optical element not including the concentrator lens (discussed further below) is approximately 20 mm.

Still referring to FIG. 9, optical element 100 includes outer surface 108, which is disposed roughly between and to the side of entry surface 104 and exit surface 106 and conforms in shape substantially to a portion of a parabola (i.e. is parabolic). It should be noted that the parabolic surface provides for many light rays to be totally reflected internally and exit the optic through top surface (exit surface) 106 at or near a normal angle relative to the top surface. However, if the entire entry surface was spherical in shape, light rays would enter at the normal to the entry surface, and thus not be bent. Therefore, only light rays which struck parabolic outer surface 108 would be reflected through top surface 106 at a normal angle. Light rays that came from the light source straight up would also exit the optic at a normal angle relative to top surface 106. All other light rays would leave the optical element through the top surface 106 at an angle and be bent away from the normal vector relative to top surface 106, since these rays would be passing from a medium with a refractive index of roughly 1.5 into air, which has a refractive index of approximately 1. This bending away would actually decrease the collimation of the light through the optical element.

The parabolic shape of outer surface 108 is defined by the formula:

$$z = \frac{cr^2}{1 + (1 - (1 - kc^2r^2))^{1/2}}$$

where x, y and z are positions on a typical 3-axis system, k is the conic constant, and c is the curvature. The formula specifies conic shapes generally. For a parabolic shape, k is less than or equal to −1. However, it should be noted that the outer surface being parabolic, and indeed being conic is just an example. Optical elements with three or more entry surfaces could be designed with outer surfaces of various shapes; for example, angled, arced, spherical, curved as well as spherical, including segmented shapes. A parabolic or partially parabolic surface as shown in the examples disclosed herein may be used to provide total internal reflection (TIR), however, there may be instances where total internal reflection is not be needed or desired at all points of the optic.

Continuing with FIG. 9, another feature of optical element 100 is concentrator lens 110 disposed in or on exit surface 106. In at least some embodiments, the concentrator lens can be molded into the optic, for example where acrylic is used and the entire optic is injection molded. As will be seen later when illustrative paths for light rays are shown and discussed, concentrator lens 110 causes light rays that would normally be bent slightly away from the normal near the center of exit surface 106 to be bent to be substantially parallel with or towards the no al, thus effectively collimating the light through optic 100 near its center. In this particular embodiment of the optical element, concentrator lens 110 is a circular Fresnel lens. A spherical concentrator lens can also be used. In the example of FIG. 9, the diameter of the Fresnel lens is approximately 11.2 mm and the radius of curvature of the outermost edge is approximately 9 mm.

Figure 10:
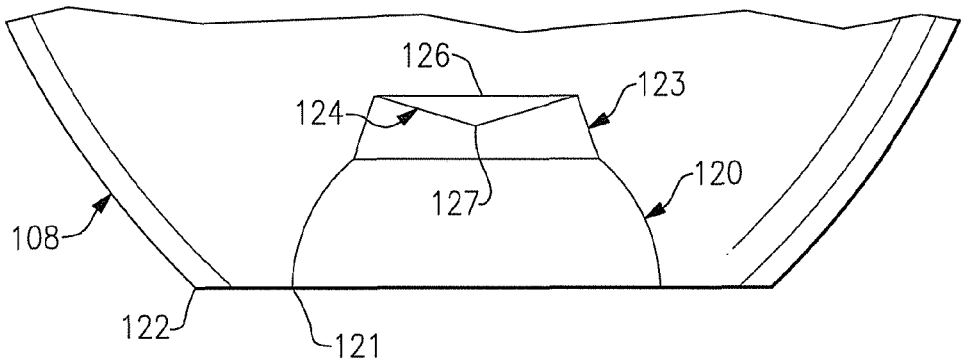
FIG. 10 is a magnified view of the entry surface portion of an optical element.
Figure 11:
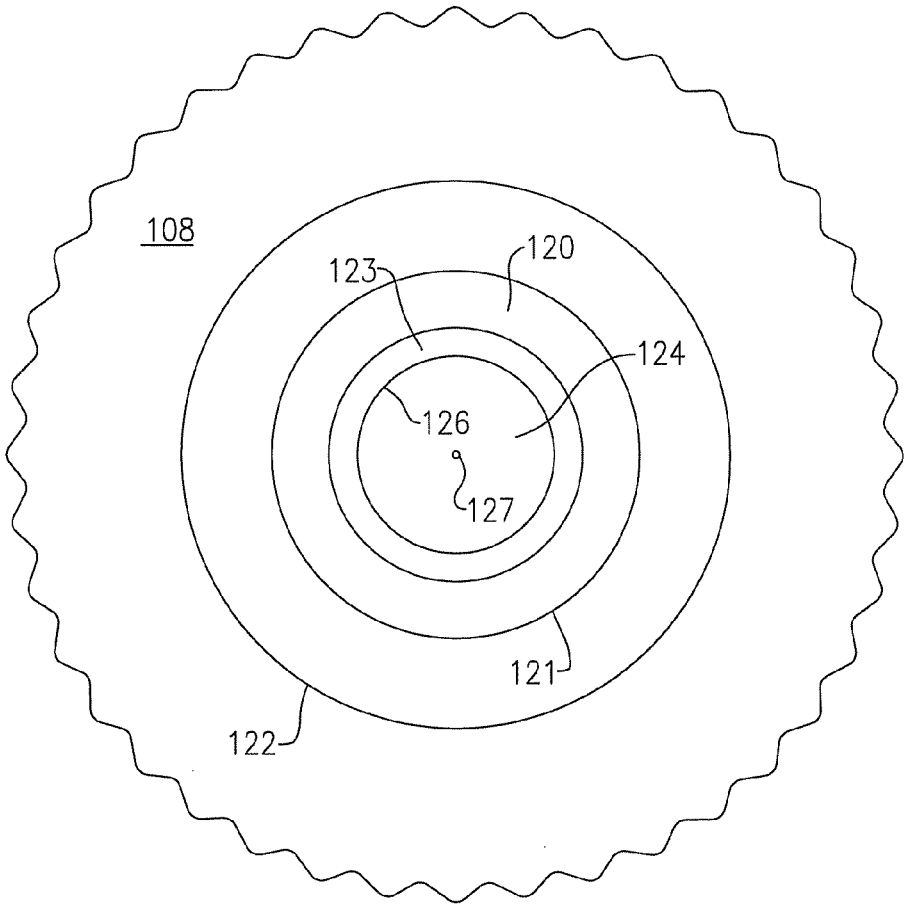
FIG. 11 is a view looking down at the bottom of the optical element depicted in FIG. 10 from inside the optical element itself.

FIG. 10 is a magnified view of the entry surface portion of optical element 100. For clarity, the multi-chip light emitter 102 is omitted from FIG. 10, and indeed the rest of the Figures described herein. FIG. 10 is shown looking through the side of the optic. FIG. 11 is a view looking down at the bottom of the optical element from inside the optical element itself. A portion of parabolic outer surface 108 is visible in FIG. 10. However, the main purpose of FIGS. 10 and 11 is to clearly illustrate the entry surface of the optical element. In this example embodiment, the entry surface includes three distinct subsurfaces, wherein each subsurface is disposed to receive light from the light source in a different direction. Each of the three subsurfaces is geometrically shaped and positioned to direct light rays entering the optical element through that subsurface in such a way as to substantially collimate the light passing through the optical element.

The subsurfaces in FIGS. 10 and 11 include spherical subsurface 120, and flat conical subsurface 123. Spherical subsurface 120 joins the bottom of the optical element in this view at the normal angle at corner 121. In this example embodiment, the spherical subsurface has a radius of curvature of approximately 3.66 mm. Corner 122 joins parabolic outer surface 108 and with corner 121 forms a flat, annular surface on the bottom of the optic. As will be seen in another example presented herein, the bottom portion of the optical element can be extended to accommodate various mounting situations. In this example embodiment, flat conical subsurface 123, has an angle of approximately 20 degrees relative to the normal.

Still referring to FIGS. 10 and 11, the third subsurface forms a shallow cone that is inverted relative to flat conic subsurface 123, and is thus referred to as inverted conic subsurface 124. The angle of the inverted conic subsurface is approximately 70 degrees to the normal vector. In some embodiments, the inverted conic subsurface has a slight radius of curvature, for example, a radius of curvature of about 12 mm. Since the optic is clear, the edge of this shallow cone is visible as edge 126 in FIGS. 10 and 11, and the point of the inverted cone is visible as point 127.

Figure 12:
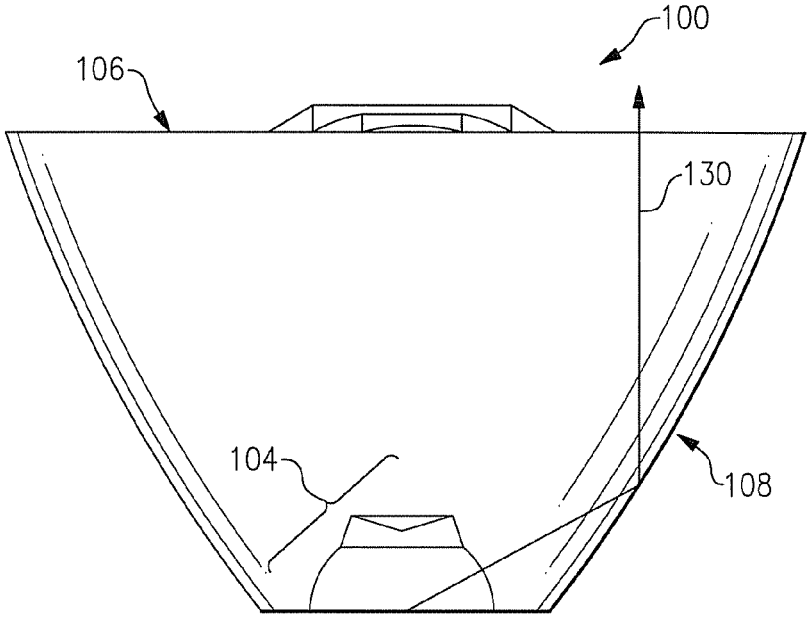
FIGS. 12, 13 and 14 illustrate the optical principle of operation of an optical element that can be employed in lighting devices according to the present inventive subject matter.
Figure 13:
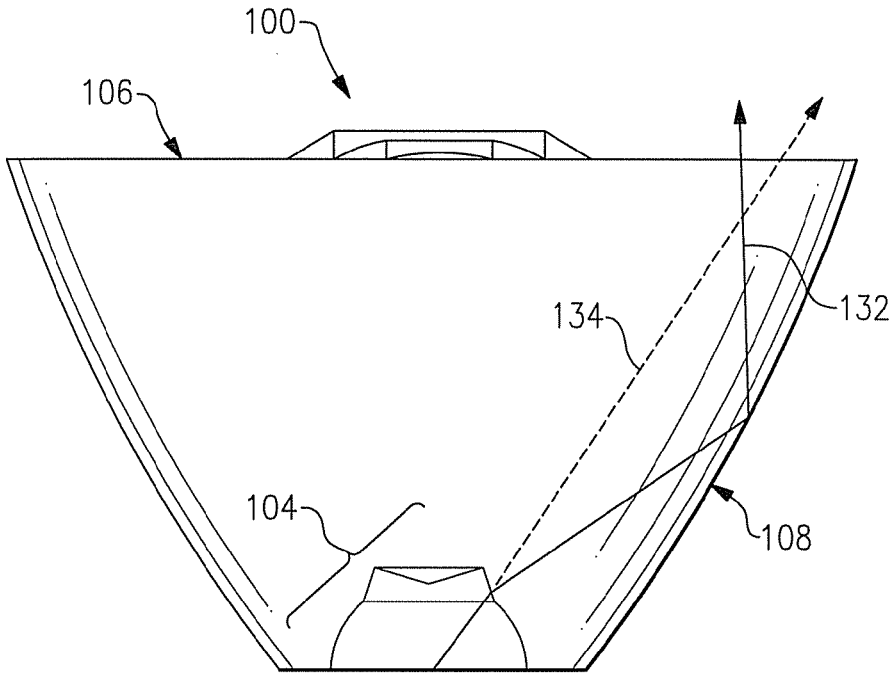
Figure 14:
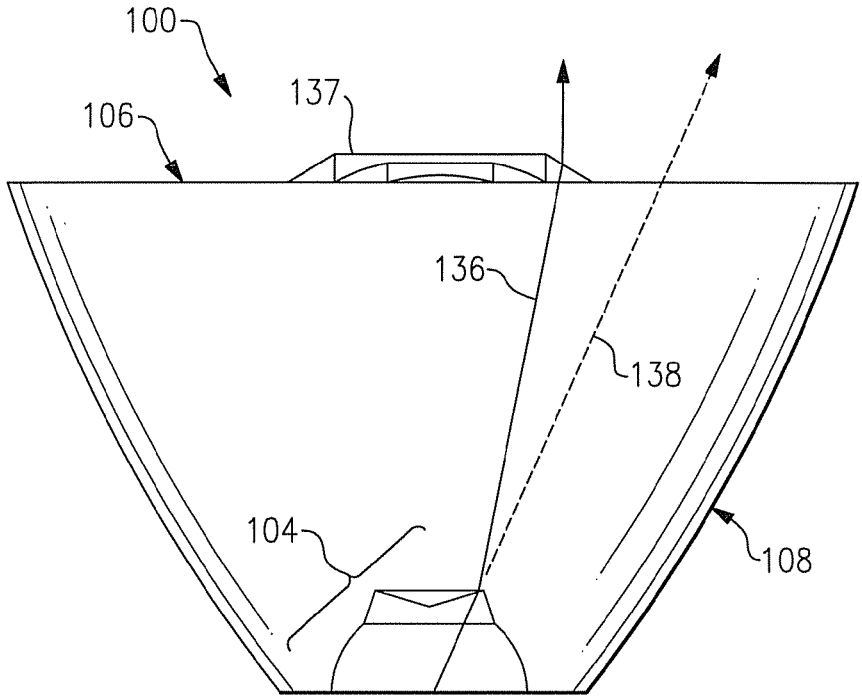

FIGS. 12, 13 and 14 illustrate the optical principle of operation of an optical element that can be employed in lighting devices according to the present inventive subject matter. FIGS. 12, 13 and 14 show the operation of the optic using different tracings of light rays, presented one each in FIG. 12, FIG. 13 and FIG. 14. FIGS. 12 through 14 illustrate the interaction of the various subsurfaces of the entry surface 104. In general, the entry surface 104 divides the light from the light source into three categories based on how the light would pass through the optic if the entire entry surface was spherical. These categories are: 1) light which would strike the parabolic surface 108 and be redirected normal to the exit surface 106; 2) light which would pass directly through the exit surface 106 but or requires a relative small amount of redirection such that it may be effectively redirected to the parabolic outer surface 108; and 3) light which would pass directly through the exit surface 106 but require redirection to such a large extent that it may not be effectively redirected to the parabolic outer surface 108. Thus, the spherical portion of the entry surface 104 is sized to receive light that would pass through the spherical portion and strike the parabolic outer surface 108 and be reflected normal to the exit surface 106. The flat conic subsurface 123 of the entry surface 104 is sized and shaped to receive a portion of the light that, otherwise, would pass through the exit surface 106 without being redirected to be normal to the exit surface 106 redirect this portion of the light to the outer wall 108 for redirection normal to the exit surface 106. The inverted conic subsurface 124 of the entry surface 104 is sized and shaped to receive a portion of the light that, otherwise, would pass through the exit surface 106 without being redirected to be normal to the exit surface 106 but which is of such an angle that it may not be effective redirect by the flat conic portion 123 and redirects this portion of the light to the concentrator 110. The size of the concentrator 110 may depend on the shape and size of the inverted conic surface 124.

FIG. 12 shows what happens to a light ray 130, which enters optical element 100 through the spherical subsurface of the entry surface 104. Such a ray is not bent on entry since the ray goes through the entry surface of the optic at a normal angle. Such a light ray strikes the parabolic outer surface 108 at an angle to the normal that is greater than the critical angle and reflects internally to exit the optic at roughly a normal angle.

FIG. 13 illustrates what happens to a light ray entering optical element 100 from the light source when the light ray passes through the flat conic subsurface 123 of entry surface 104. Light ray 132 is bent towards the normal when it passes through the flat conic subsurface, and strikes parabolic outer surface 108 at an angle that is greater than the critical angle. Light ray 132 then reflects upwards and passes out of the optic at an angle relatively close to the normal vector, keeping the light collimated. Note that dotted light ray 134 illustrates the path a light ray would have taken if it had passed through an entirely spherical entry surface. Light ray 134 misses parabolic outer surface 108 and leaves the optic through exit surface 106 angled away from the center line of the optic. Because the light ray would have been bent away from the normal by passing from a medium with a high index of refraction to a medium with a low index of refraction, it would have left the optic at an even greater angle and been bent far away from the center line of the optical element, reducing collimation of the light.

FIG. 14 illustrates what happens to a light ray entering optical element 100 from the light source when the light ray passes through the inverted conic subsurface 124 of entry surface 104. Light ray 136 is bent towards the normal when it passes through the inverted conic subsurface, since it is passing from a medium with a lower index of refraction into a medium with a higher index of refraction. In this case, light ray 138 is bent enough to pass through the outer portion 137 of the Fresnel concentrator lens, and ends up leaving the optic almost parallel to the normal. Thus, the inverted conic portion of the entry subsurface also serves to collimate the light passing through the optical element. Note that dotted light ray 138 illustrates the path a light ray would have taken had the entry surface of the optic been completely spherical. In this case, the light ray misses parabolic outer surface 108 and the concentrator lens, and exits the optic through exit surface 106 angled away from the center line of the optic. Because such a light ray would have been bent away from the normal by passing from a medium with a high index of refraction to a medium with a low index of refraction, it would have left the optic at an even greater angle and been bent far away from the center line of the optical element, reducing collimation of the light.

The details of the entry surface of embodiments of the optic disclosed herein are but one example of how an optical element with an entry surface having three or more subsurfaces of different shapes or contours can be implemented. Various combinations of shapes and contours can be used for the subsurfaces of an entry surface of the optic. For example, curved, segmented, angled, spherical, conical, parabolic and/or arced surfaces can be used in various combinations. Subsurfaces of the entry surface as disclosed in the detailed examples herein can be used in a different arrangement. A subset of these subsurfaces (e.g. one or two) can be used in combination with a subsurface or subsurfaces of other shapes.

Figure 15:
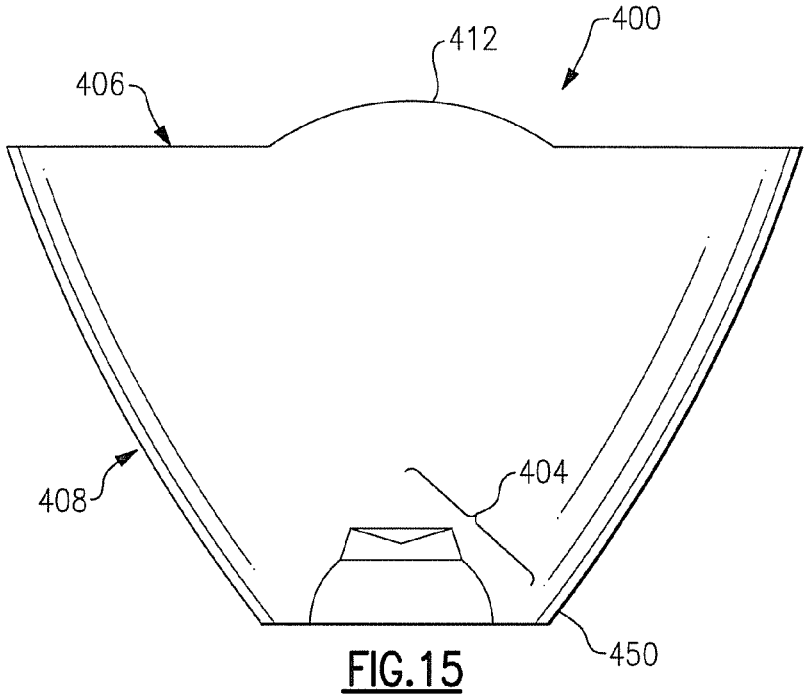
FIG. 15 is a cross-sectional side view of an optical element that can be employed in lighting devices according to the present inventive subject matter.

FIG. 15 is another cross-sectional side view of an optical element optical element that can be employed in lighting devices according to the present inventive subject matter. In this case, the optical element has a spherical concentrator lens. Optic 400 includes entry surface 404. Light enters the optical element through one of the subsurfaces of the entry surface and exits the optical element through exit surface 406, which is positioned opposite entry surface 404. Optical element 400 includes parabolic outer surface 408, which is disposed roughly between and to the side of entry surface 404 and exit surface 406 as before. Again, the parabolic surface provides for many light rays, particularly those that enter the optic through the spherical subsurface of the entry surface to be totally reflected internally and exit the optic through exit, or top surface 406 at or near a normal angle relative to top surface 406. Optical element 400 has a spherical concentrator lens 412 disposed in or on exit surface 406. In at least some embodiments, the concentrator lens can be molded into the optic, for example where acrylic is used and the entire optic is injection molded. It should be noted that any concentrator lens is optional, since some lighting effects that may be desirable would not require a concentrator lens with some entry surfaces, and lenses of different types could also be used, including lenses that combine different types of surfaces. In the example shown in FIG. 15, the spherical concentrator lens has a diameter of approximately 11.2 mm and a radius of curvature of approximately 9 mm.

FIG. 15 shows another possible variation of the optical element. In the case of this embodiment, the outer surface extends down further than in previous embodiments, so that the base of optic has a more protruding annular section 450, which may allow the optic to rest more directly on a surface, depending on the particulars of the lighting system in which it is used.

There are almost infinite variations of embodiments of the optical element and lighting system of the present inventive subject matter. Angles, sizes and placements of the subsurfaces that direct incoming light rays can be varied and additional subsurfaces can be included. Many variations of all of the surfaces of the optical element are possible. For example, the size and relationship of the various surfaces may depend on the size and light output characteristics of the light source, the desired beam angle, the amount of light mixing required and/or the materials used in the optic. Indeed, the entry surface of an optic according to embodiment of the inventive subject matter can even be designed for various lighting effects, including effects in which the light is not collimated, but instead formed to project decorative or utilitarian patterns of various kinds. Such variations can be used with outer surfaces of various shapes, and with or without concentrator lenses. Variations can be designed using photometric simulation software tools that provide ray tracings and/or isolux curves. Such tools are publicly available from various sources. One example of such a computer software simulation tool is Photopia, published by LTI Optics, LLC, of Westminster, Colorado, USA.

Figure 16:
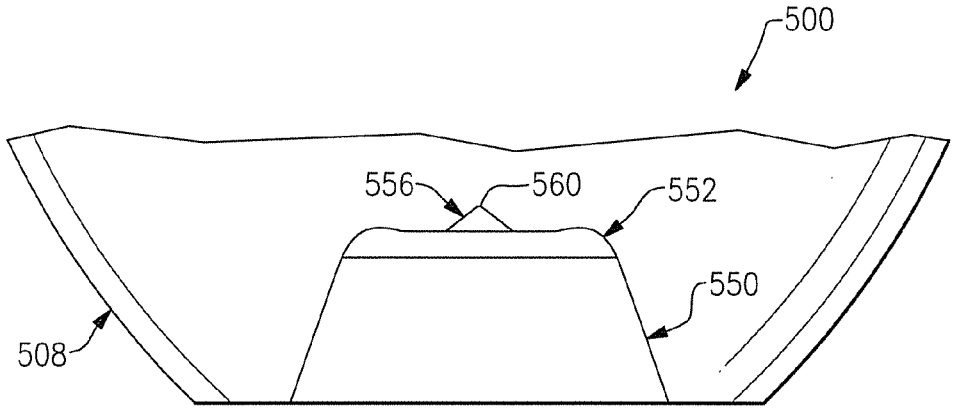
FIG. 16 shows a cutaway, magnified, cross-sectional view of an entry surface of an optic having an outer surface.

FIG. 16 illustrates another variation of the entry surface for embodiments of the optic. FIG. 16 shows a cutaway, magnified, cross-sectional view of the entry surface of an optic, 500, having outer surface 508. In the example of FIG. 16, the entry surface includes flat subsurface 550, spherical subsurface 552 and inverted spherical subsurface 556. In this example, flat subsurface 550 is angled to the normal vector at an angle of approximately 20 degrees. Spherical subsurface 552 has a smaller radius of curvature than inverted spherical subsurface 556. Also, inverted spherical subsurface 556 extends upward around the normal vector through the center of the optic so that it forms point 560.

Figure 17:
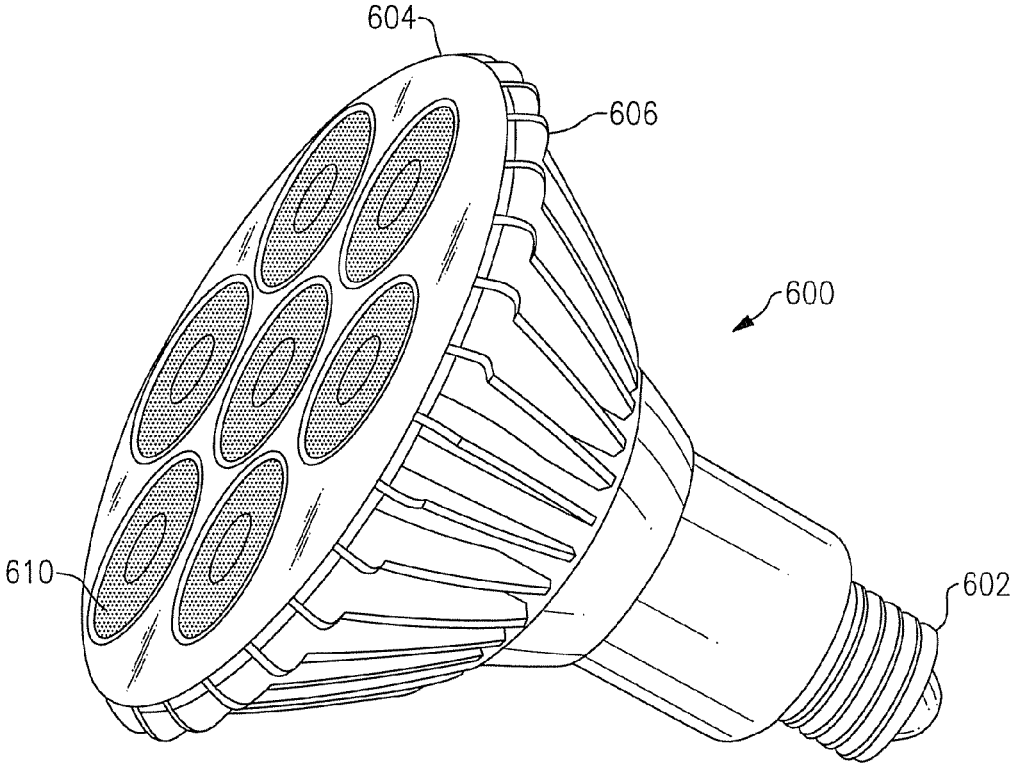
FIG. 17 is an illustration of a lighting system making use of an optical element.

FIG. 17 is an illustration of a lighting system making use of an optical element as described herein. Lighting system 600 is formed to be a replacement for a standard R30 incandescent bulb of the type commonly used in so-called "recessed can" ceiling light fixtures. The lighting system includes a standard threaded base 602. Seven multi-chip light emitters are used as the light sources and are located inside the lighting system behind front plate 604. Cooling fins 606 aid in maintaining an appropriate operating temperature inside the system. There is a void above each lighting element, and each void contains an optical element 610.

The top surface of each optical element in FIG. 17 includes a color mixing treatment, visible in FIG. 17 as dots or stipples on the top surface of the optic that serve as a diffractive surface treatment on the exit surface. An alternative color mixing treatment would be to provide caps made of volumetric diffusion material spaced a small airgap way from the exit surface. This cap would be fitted over each optical element, and would not significantly alter the appearance of the system of FIG. 17, since in order to maintain the airgap, each cap could have a bump-out over the concentrator lens. Other possible color mixing treatments include a patterned lens treatment, which again, if applied to the exit surface would not alter the appearance of the system of FIG. 17 significantly. Faceting on the entry surface or the parabolic surface of the optical element could also be used as a color mixing treatment, in which case the dots or stippling on top of each optic in FIG. 17 might not be present.

The invention claimed is:

1. A lighting device comprising:

at least a first multi-chip light emitter and a second multi-chip light emitter, the first multi-chip light emitter comprising at least a first solid state light emitter and a second solid state light emitter, the second multi-chip light emitter comprising at least a third solid state light emitter and a fourth solid state light emitter, the first solid state light emitter emitting light of a first hue, the second solid state light emitter emitting light of a second hue, the third solid state light emitter emitting light of a third hue, the fourth solid state light emitter emitting light of a fourth hue, the first hue differing from the third hue by fewer MacAdam ellipses than the number of MacAdam ellipses by which:

the first hue differs from the second hue, the first hue differs from the fourth hue, the second hue differs from the third hue, the second hue differs from the fourth hue, or the third hue differs from the fourth hue, the first solid state light emitter spatially offset relative to the third solid state light emitter by at least 10 degrees.

2. A lighting device as recited in claim 1, wherein:

the first multi-chip light emitter comprises three BSY solid state light emitters and one red solid state light emitter, and the second multi-chip light emitter comprises three BSY solid state light emitters and one red solid state light emitter.

3. A lighting device as recited in claim 1, wherein the first solid state light emitter is a BSY solid state light emitter.

4. A lighting device as recited in claim 3, wherein:

the first hue differs from the third hue by not more than seven MacAdam ellipses, the first hue differs from the second hue by more than seven MacAdam ellipses, the first hue differs from the fourth hue by more than seven MacAdam ellipses, the second hue differs from the third hue by more than seven MacAdam ellipses, the second hue differs from the fourth hue by more than seven MacAdam ellipses, and the third hue differs from the fourth hue by more than seven MacAdam ellipses.

5. A lighting device as recited in claim 3, wherein:

the lighting device further comprises at least a third multi-chip light emitter the third multi-chip light emitter comprises at least a fifth solid state light emitter and a sixth solid state light emitter, the fifth solid state light emitter emits light of a fifth hue, and the sixth solid state light emitter emits light of a sixth hue.

6. A lighting device as recited in, claim 3, wherein:

the lighting device further comprises at least a third multi-chip light emitter and a fourth multi-chip light emitter.

7. A lighting device as recited in claim 6, wherein each of the first, second, third and fourth multi-chip light emitters have similar layouts.

8. A lighting device as recited in claim 3, wherein:

the lighting device further comprises at least a third multi-chip light emitter, and each of the first, second and third multi-chip light emitters comprises at least four solid state light emitters.

9. A lighting device as recited in claim 8, wherein each of the first, second and third multi-chip light emitters have similar layouts.

10. A lighting device as recited in claim 3, wherein the second solid state light emitter is a red solid state light emitter.

11. A lighting device as recited in claim 3, wherein the second solid state light emitter is a red solid state light emitter, the third solid state light emitter is a BSY solid state light emitter, and the fourth solid state light emitter is a red solid state light emitter.

12. A lighting device comprising:

at least a first multi-chip light emitter, a second multi-chip light emitter and a third multi-chip light emitter, the first multi-chip light emitter comprising at least a first solid state light emitter, a second solid state light emitter, a third solid state light emitter and a fourth solid state light emitter, the second multi-chip light emitter comprising at least a fifth solid state light emitter, a sixth solid state light emitter, a seventh solid state light emitter and an eighth solid state light emitter, the third multi-chip light emitter comprising at least a ninth solid state light emitter, a tenth solid state light emitter, an eleventh solid state light emitter and a twelfth solid state light emitter, the first solid state light emitter emitting light of a first hue, the second solid state light emitter emitting light of a second hue, the fifth solid state light emitter emitting light of a fifth hue, the sixth solid state light emitter emitting light of a sixth hue, the ninth solid state light emitter emitting light of a ninth hue, the tenth solid state light emitter emitting light of a tenth hue, the first hue differing from the fifth hue by not more than seven MaeAdam ellipses, the first hue differing from the ninth hue by not more than seven MacAdam ellipses, the fifth hue differing from the ninth hue by not more than seven MacAdam ellipses, the first hue differing from each of the second hue, the sixth hue and the tenth hue by more than seven MacAdam ellipses, the fifth hue differing from each of the second hue, the sixth hue and the tenth hue by more than seven MacAdam ellipses, the ninth hue differing from each of the second hue, the sixth hue and the tenth hue by more than seven MacAdam ellipses, any solid state light emitter in the second multi-chip light emitter that is spatially offset relative to the first solid state light emitter by less than 10 degrees having a hue that differs from the first hue by more than seven MacAdam ellipses.

13. A lighting device as recited in claim 12, wherein the first solid state light emitter is a BSY solid state light emitter.

14. A lighting device as recited in claim 13, wherein any solid state light emitter in the second multi-chip light emitter that is spatially offset relative to the first solid state light emitter by less than 80 degrees has a hue that differs from the first hue by more than seven MacAdam ellipses.

15. A lighting device as recited in claim 13, wherein the lighting device comprises at least four multi-chip light emitters that have similar layouts.

16. A lighting device as recited in claim 15, wherein the fifth solid state light emitter is spatially offset by about 90 degrees relative to the first solid state light emitter.

17. A lighting device as recited in claim 15, wherein the fifth solid state light emitter is spatially offset by about 180 degrees relative to the first solid state light emitter.

18. A lighting device as recited in claim 13, wherein the second solid state light emitter is a red solid state light emitter, the fifth solid state light emitter is a BSY solid state light emitter, and the sixth solid state light emitter is a red solid state light emitter.

19. A lighting device comprising:

at least a first multi-chip light emitter and a second multi-chip light emitter, the first multi-chip light emitter comprising at least a first solid state light emitter, a second solid state light emitter and a third solid state light emitter, the second multi-chip light emitter comprising at least a fourth solid state light emitter, a fifth solid state light emitter and a sixth solid state light emitter, the first solid state light emitter emitting light of a first hue, the second solid state light emitter emitting light of a second hue, the third solid state light emitter emitting light of a third hue, the fourth solid state light emitter emitting light of a fourth hue, the fifth solid state light emitter emitting light of a fifth hue, the sixth solid state light emitter emitting light of a sixth hue, the second hue differing from the first hue by not more than seven MacAdam ellipses, the third hue differing from the first hue by more than seven MacAdam ellipses, the fifth hue differing from the fourth hue by not more than seven MacAdam ellipses, and the sixth hue differing from the fourth hue by more than seven MacAdam ellipses.

20. A lighting device as recited in claim 19, wherein the first solid state light emitter is a BSY solid state light emitter.

21. A lighting device as recited in claim 20, wherein the second solid state light emitter is a red solid state light emitter, the third solid state light emitter is a BSY solid state light emitter, and the fourth solid state light emitter is a red solid state light emitter.

22. A lighting device comprising:

at least a first multi-chip light emitter and a second multi-chip light emitter, the first multi-chip light emitter comprising at least a first solid state light emitter and a second solid state light emitter, the second multi-chip light emitter comprising at least a third solid state light emitter and a fourth solid state light emitter, the first solid state light emitter emitting light of a hue that differs from the hue of light that is emitted by the second solid state light emitter, the third solid state light emitter emitting light of a hue that differs from the hue of light that is emitted by the fourth solid state light emitter, (1) the at least first and second solid state light emitters on the first multi-chip light emitter spatially arranged relative to one another, (2) the at least third and fourth solid state light emitters on the second multi-chip light emitter spatially arranged relative to one another, and (3) the at least first and second multi-chip light emitters spatially arranged relative to one another, to provide adequate color mixing of light emitted from the lighting device, in which when the lighting device is supplied with electricity, the hue of each of 100 substantially square regions of equal surface area dividing a surface area of a beam of light emitted by the lighting device differs from the hue of each of the other of the 100 substantially square regions by not more than seven MacAdam ellipses, the surface area of the beam of light at a distance, along an axis perpendicular to an emission plane of the lighting device, of six times a diameter of a surface of the lighting device.

23. A lighting device as recited in claim 22, wherein the first solid state light emitter is a BSY solid state light emitter.

24. A lighting device as recited in claim 23, wherein the second solid state light emitter is a red solid state light emitter, the third solid state light emitter is a BSY solid state light emitter, and the fourth solid state light emitter is a red solid state light emitter.

25. A lighting device as recited in clam 23, wherein when the lighting device is supplied with electricity, the lighting device emits light having a CRI Ra of at least 80.

* * * * *

UNITED STATES PATENT AND TRADEMARK OFFICE

CERTIFICATE OF CORRECTION

PATENT NO. : 8,508,116 B2
APPLICATION NO. : 12/776947
DATED : August 13, 2013
INVENTOR(S) : Gerald H. Negley, Mark D. Edmond and Paul Kenneth Pickard It is certified that error appears in the above-identified patent and that said Letters Patent is hereby corrected as shown below:

In the Specification

Column 24, line 14: Please change "METIIOD" to -- METHOD --

Column 24, lines 19-20: Please change "i" "f" to -- if --

Column 24, line 42: Please change "ILLIJMINATION" to -- ILLUMINATION --

Column 30, line 51: Please change "LIGIIT" to -- LIGHT --

Column 38, line 27: Please change "ATTACIIMENT" to -- ATTACHMENT --

In the Claims

Column 56

Claim 25, line 28: Please change "clam" to -- claim --

Signed and Sealed this
Nineteenth Day of November, 2013

Teresa Stanek Rea

Teresa Stanek Rea
*Deputy Director of the United States Patent and Trademark Office*